US011130216B2

(12) United States Patent
Hermansen et al.

(10) Patent No.: US 11,130,216 B2
(45) Date of Patent: Sep. 28, 2021

(54) SELECTIVELY ADJUSTABLE TORQUE INDICATING TOOL

(71) Applicants: Frank Hermansen, Corona del Mar, CA (US); Carl Winefordner, Laguna Beach, CA (US)

(72) Inventors: Frank Hermansen, Corona del Mar, CA (US); Carl Winefordner, Laguna Beach, CA (US)

( * ) Notice: Subject to any disclaimer, the term of this patent is extended or adjusted under 35 U.S.C. 154(b) by 340 days.

(21) Appl. No.: 16/109,590

(22) Filed: Aug. 22, 2018

(65) Prior Publication Data

US 2020/0061784 A1 Feb. 27, 2020

(51) Int. Cl.

| | |
|---|---|
| ***B25B 23/142*** | (2006.01) |
| ***B25B 15/00*** | (2006.01) |
| ***B25G 1/08*** | (2006.01) |

(52) U.S. Cl.

CPC ..... *B25B 23/1427* (2013.01); *B25B 15/008* (2013.01); *B25G 1/085* (2013.01); *B25B 15/005* (2013.01); *B25B 15/007* (2013.01)

(58) Field of Classification Search

CPC . B25B 23/1427; B25B 15/008; B25B 15/005; B25B 15/007; B25G 1/085

See application file for complete search history.

(56) References Cited

U.S. PATENT DOCUMENTS

| | | | | |
|---|---|---|---|---|
| 1,519,800 A | | 12/1924 | Rifflard | |
| 2,283,888 A | | 5/1942 | Zimmerman | |
| 2,303,411 A | | 12/1942 | Van Horn | |
| 2,371,901 A | | 3/1945 | Livermont | |
| 2,385,591 A | | 9/1945 | Sturtevant | |
| 2,400,205 A | | 5/1946 | Livermont | |
| 2,442,359 A | | 6/1948 | Hattan | |
| 2,472,659 A | * | 6/1949 | Greer | B25B 23/1427 81/477 |
| 2,558,158 A | * | 6/1951 | Rock | B25B 23/1427 464/23 |
| 3,076,362 A | | 2/1963 | Able | |
| 3,701,295 A | * | 10/1972 | Mende | B25B 23/142 81/477 |

(Continued)

OTHER PUBLICATIONS

Birzman, "Multi-Tools", web page, Jun. 27, 2018, 1 page.

(Continued)

*Primary Examiner* — Hadi Shakeri

(74) *Attorney, Agent, or Firm* — Stetina Brunda Garred & Brucker

(57) ABSTRACT

A selectively adjustable torque indicating tool is provided for rotating a mechanical fastener to a predetermined torque setting. The tool includes a pair of supports and a tool bit positioned between the pair of supports and engageable with a mechanical fastener such that when the tool bit, a rotational force is imparted on the mechanical fastener. A spring is coupled to the pair of supports, and operatively coupled to the tool bit. The spring includes a first end portion movable relative to the pair of supports between a neutral position and a torqued position in response to the rotational force being imparted on the mechanical fastener by the tool bit. An adjuster is coupled to the spring to adjust a stiffness of the spring such that movement of the first end portion of the spring from the neutral position to the torqued position corresponds to a predefined rotational force.

19 Claims, 16 Drawing Sheets

(56) References Cited

U.S. PATENT DOCUMENTS

| | | | | |
|---|---|---|---|---|
| 4,664,001 | A | 5/1987 | Denman | |
| 4,838,134 | A | 6/1989 | Ruland | |
| 4,852,386 | A | 8/1989 | Grabovac et al. | |
| 7,093,522 | B2 * | 8/2006 | Guy | B25B 23/1425 81/479 |
| 8,897,850 | B2 * | 11/2014 | Jochim | A61B 5/6826 600/344 |
| 9,533,404 | B2 * | 1/2017 | Hu | B25B 15/02 |
| 2017/0334045 | A1 | 11/2017 | Kuo | |

OTHER PUBLICATIONS

Topeak, web pages, Jun. 27, 2018, 4 pages.
IceToolz, "E219 Ocarina Torque Wrench Set", web page <http://www.icetoolz.com/ec99/rwd1111/product.asp?prodid=E219>, Jun. 27, 2018, 1 page.
Photograph of torq tools, Jun. 27, 2018, 1 page.

* cited by examiner

SELECTIVELY ADJUSTABLE TORQUE INDICATING TOOL

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates to a tool for tightening fasteners to specified torque values, and more particularly to a tool that can be adjusted to tighten fasteners to the desired torque.

2. Description of the Related Art

Stand-alone torque wrenches are typically elongated and have a single torque tool bit and work by various means, most commonly by either adjusting a compression coil spring that controls when the head rocks and clicks or by bending a long beam that moves across a pattern of marks to indicate torque applied. Both types of torque wrenches usually have a single socket receptacle that requires the user to use many different separate tool bits for each application. In both cases, these tools may be too big and heavy to practically carry along on a remote activity.

Another type of torque tool is non-adjustable and preset to a particular torque level such as 5 Newton-meters (Nm). Usually these types of torque tools have an internal coil compression spring and a cam that when the torque level is reached, allows the tool bit to rotationally skip a certain rotational amount, such as 90 degrees or 180 degrees. Pre-set torque tools are sometimes large T-handled tools and not particularly portable and sometimes smaller cylinders that can adapt to other tool drivers.

Torque tools are not commonly owned by the average household, as they are oftentimes viewed as specialty tools for advanced mechanics. Instead, the average household is more likely to have a limited number of tools, and may own a multi-tool, which may be handy for many jobs around the house, on cars, sports equipment, furniture, and appliances. While multi-tools may be helpful for basic mechanical tasks, torque specifications are becoming more and more common in order to prevent over or under-tightening. The increase in online shopping has made this issue more prevalent, as many products require assembly upon receipt.

Along these lines, many products may be associated with specified torque requirements for fasteners which are high enough to prevent accidental loosening and low enough to prevent damage. For example, cars use many different torque settings on various parts. A multi-tool having a single pre-set torque is not particularly useful because there are so many different torque requirements on different parts of different products.

Accordingly, there is a need in the art for a multi-tool having torque indicating capabilities. Various aspects of the present disclosure address this particular need, as will be discussed in more detail below.

BRIEF SUMMARY

An object of the present disclosure is to have a multi-tool that can be adjusted to indicate different torque settings and to allow for accurate tightening to a specified torque value. Another object is to have a multi-tool that can still function as a normal multi-tool. Yet another object is for the multi-tool cost to be reasonable and affordable. Another object is for the multi-tool to be able to be made in various sizes and for specific uses. Another object is a minimal increase in cost, size and weight of the multi-tool compared to a regular multi-tool. Another object is to have a stand-alone torque wrench that is simple and inexpensive to manufacture, yet easy and intuitive to use.

In accordance with one embodiment of the present disclosure, there is provided a selectively adjustable torque indicating tool for rotating a mechanical fastener to a predetermined torque setting. The torque indicating tool includes a pair of supports extending in opposed relation to each other. A tool bit is positioned between the pair of supports and is engageable with the mechanical fastener along an engagement axis such that when the tool bit is rotated about the engagement axis, a rotational force is imparted on the mechanical fastener to urge the mechanical fastener to rotate about the engagement axis when the tool bit is engaged with the mechanical fastener. The torque indicating tool additionally includes a spring coupled to the pair of supports, and operatively coupled to the tool bit. The spring includes a first end portion that is movable relative to the pair of supports between a neutral position and a torqued position in response to the rotational force being imparted on the mechanical fastener by the tool bit. An adjuster is coupled to the spring to adjust a stiffness of the spring such that movement of the first end portion of the spring from the neutral position to the torqued position corresponds to a predefined rotational force.

The tool bit may be coupled to the pair of supports such that the tool bit is rotatable relative to the pair of supports about a rotation axis. The tool bit may be additionally moveable about an axis offset from the rotation axis.

The torque indicating tool may additionally include a shaft extending between the pair of supports, with the tool bit being rotatable about the shaft. The tool bit may include a first surface, an opposing second surface, and an opening extending between the first and second surfaces. The opening may have a variable diameter that is of a minimum magnitude between the first and second surfaces.

The spring may be a leaf spring. The leaf spring may define a spring length corresponding at least in part to the position of the adjuster relative to the leaf spring, such that the spring rate may be adjustable via movement of the adjuster relative to the leaf spring. The adjuster may be translatably coupled to one of the pair of supports. The leaf spring may include a slot formed therein, the torque wrench further comprising a shaft extending through the slot and between the pair of supports.

The tool bit may include a fastener engagement portion engageable with an Allen screw.

The spring may be a coil spring. At least one of the pair of supports may include an opening. The coil spring may extend through the opening. The torque indicating tool may additionally include an indicator body moveable relative to the pair of supports in accordance with movement of the first end portion of the spring. The adjuster may be aligned with the opening and rotatable about an axis extending through the opening. The torque indicating tool may additionally include a shaft coupled to at least one of the pair of supports and aligned with the axis extending through the opening, with the adjuster being threadedly engaged with the shaft. The adjuster may include an annular cavity formed therein, with a portion of the coil spring extending within the annular cavity.

According to another embodiment, the torque indicating tool may include a support, and a first tool bit coupled to the support. The first tool bit may be further moveable relative to the support about a first torque axis. A spring may extend along a spring axis between a first end and a second end. An adjuster may be operatively coupled to the spring and moveable relative to the spring along the spring axis to define a bendable portion of the spring as that portion of the spring between the adjuster and the first end of the spring. The bendable portion of the spring may define a spring rate such that movement of the adjuster along the spring axis adjusts the spring rate. The spring may be operatively coupled to the first tool bit such that movement of the first tool bit about the first torque axis causes the bendable portion of the spring to move relative to the support.

The torque indicating tool may additionally include a second tool bit coupled to the support. The second tool bit may be rotatable relative to the support about the rotation axis, with the second tool bit further being moveable about a second torque axis offset from the rotation axis. The spring may be operatively coupled to the second tool bit such that movement of the second tool bit about the second torque axis causes the bendable portion of the spring to move relative to the support.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of a torque indicating tool and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Figure 1:
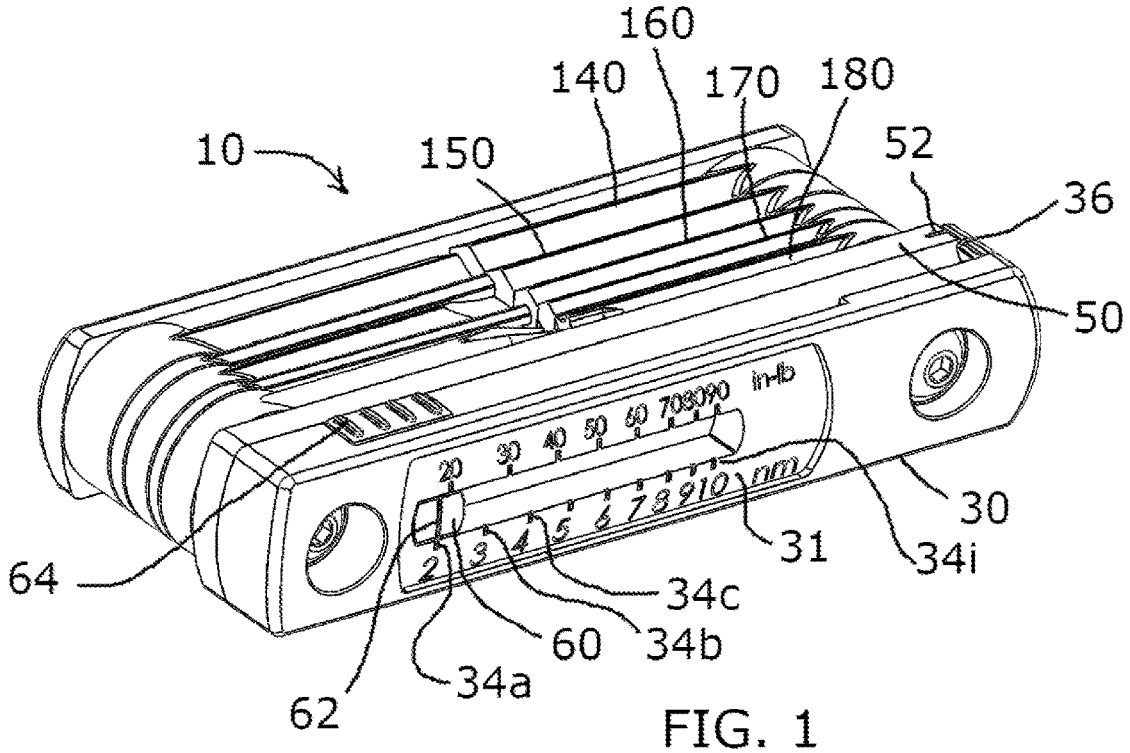
FIG. 1 is a perspective view of a first embodiment of a torque indicating multi-tool set to 2 Nm.
Figure 2:
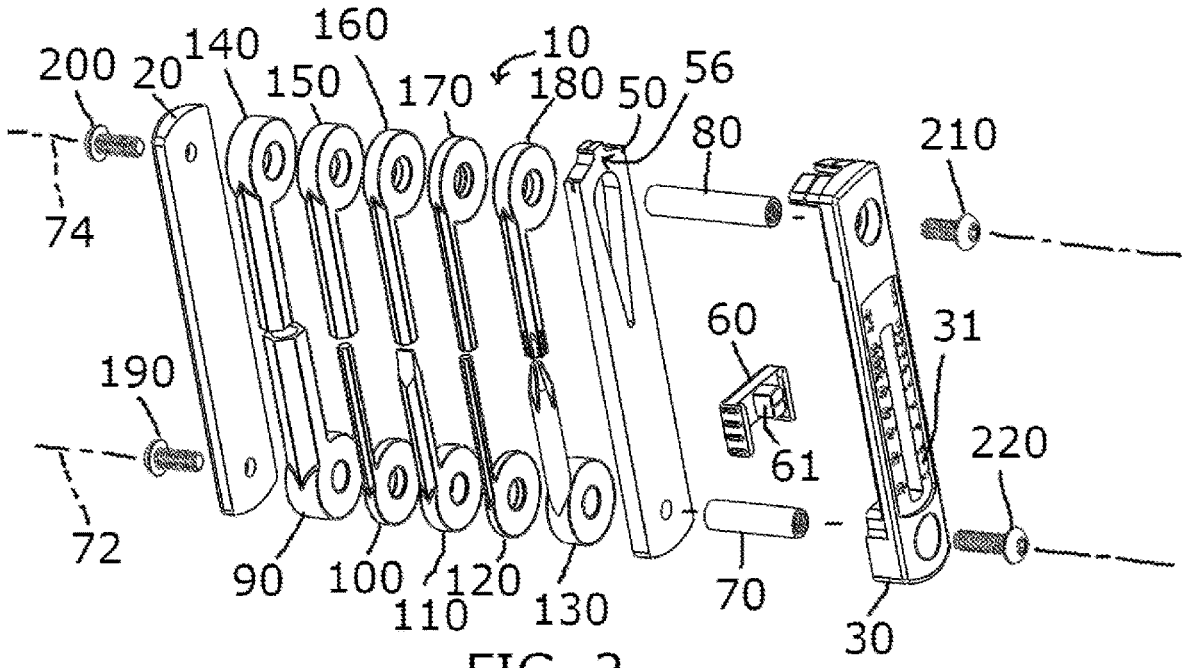
FIG. 2 is an exploded view of the first embodiment of torque indicating multi-tool.

FIGS. 1-2 show an embodiment of a torque indicating tool 10 (e.g., a torque wrench) generally comprised of a pair of supports 20, 30, a spring 50, a slider 60, a pair of threaded shafts 70, 80, a plurality of tool bits 90, 100, 110, 120, 130, 140, 150, 160, 170, 180, and screws 190, 200, 210, 220. Supports 20, 30 may be generally elongate and define a length that is approximately twice as long as the tool bits 90, 100, 110, 120, 130, 140, 150, 160, 170, 180 so as to allow the tool bits 90, 100, 110, 120, 130, 140, 150, 160, 170, 180 to be arranged between the supports 20, 30 in two end-to-end groups. The supports 20, 30 are arranged in generally opposed relation to each other and are secured to each other via the pair of shafts 70, 80 and screws 190, 200, 210, 220. In particular, each support 20, 30 may include a pair of holes, which may be aligned with a respective threaded shaft 70, 80. A screw 190, 200, 210, 220 may be inserted in a respective hole in a given support 20, 30, such that the external threads on the screw 190, 200, 210, 220 engage with the internal threads on the shafts 70, 80 to facilitate engagement therebetween. When the supports 20, 30 are connected via the threaded shafts 70, 80 and screws 190, 200, 210, 220, the supports 20, 30 may be spaced from each other to accommodate the tool bits 90, 100, 110, 120, 130, 140, 150, 160, 170, 180, as will be described in more detail below.

Figure 14:
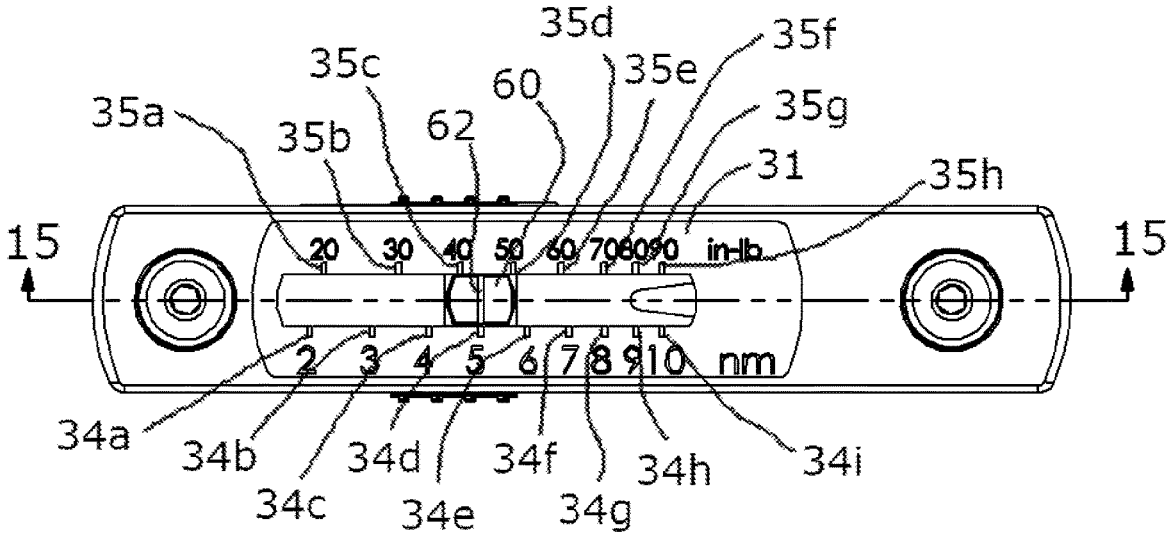
FIG. 14 is a side view of the first embodiment of torque indicating multi-tool.
Figure 15:
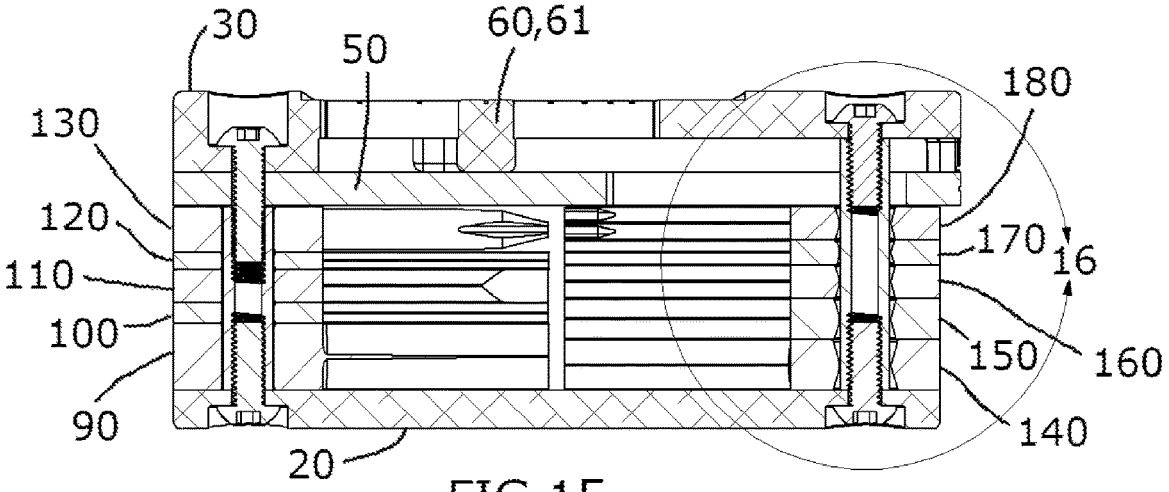
FIG. 15 is a section view of FIG. 14.

Support 30 may include an indicator surface 31 having torque indicator lines 34*a*-34*i* and 35*a*-35*h* (see FIG. 14) at various distances from each other along a slot 36 formed in support 30. The indicator lines 34*a*-34*i* may represent torque settings in a first unit, such as Newton-meters (Nm), while indicator lines 35*a*-35*h* may represent torque settings in a second unit, such as inch-pounds (in-lb). Slot 36 may extend in a first direction along a longitudinal axis of the support 30, and in a second direction between opposing inner and outer surfaces of the support 30. The slot 36 may be sized to operatively engage with slider 60, which may translate along the support 30 within slot 36.

Figure 12:
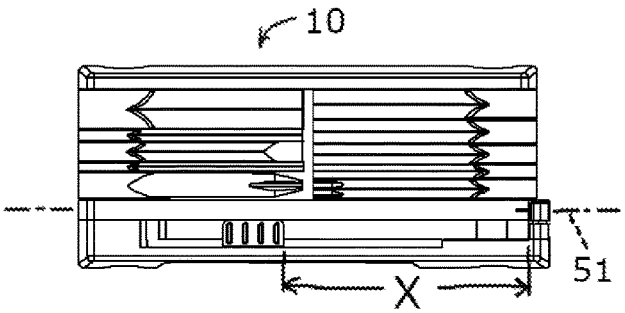
FIG. 12 is a top view of the first embodiment of torque indicating multi-tool.
Figure 13:
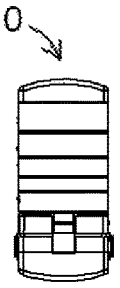
FIG. 13 is an end view of the first embodiment of torque indicating multi-tool.

The slider 60 (e.g., the adjuster) may include a nub or protrusion 61 extending into the slot 36 to guide slider 60 in slot 36. The slider 60 may include an indicator line 62 formed on a distal surface of protrusion 61 which may be selectively aligned with indicator lines 34*a*-34*i* and 35*a*-35*h* on the support 30 as the slider 60 translates relative to support 30. The slider 60 may move along a spring axis 51 (see FIG. 12) defined by the longitudinal dimension of the spring 50 such that the position of indictor 60 relative to support 30 changes the bending spring rate of spring 50. The slider 60 may include a pair of opposed grip surfaces 64 that allows the user to intentionally slide slider 60 to the desired location. The grip surfaces 64 may be spaced apart and located adjacent respective edges of support 30. FIG. 1 shows tool 10 with slider 60 in the 2 Nm torque setting. In this setting shown, slider 60 indicator line 62 is aligned with support 30 indicator line 34*a*.

The tool bits 90, 100, 110, 120, 130, 140, 150, 160, 170, 180 may be positioned between the pair of supports 20, 30, with each tool bit 90-180 being uniquely configured to engage with a different mechanical fastener, such as an Allen screw, flathead screw, Phillips head screw, torx screw, etc. In this regard, each tool bit 90-180 may define a respective engagement axis extending longitudinally along the tool bit 90-180. A rotational force may be imparted on the mechanical fastener to rotate about the engagement axis of the particular tool bit, when the particular tool bit is engaged with the mechanical fastener.

The tool bits 90-180 may be arranged into two separate groupings. In the exemplary embodiment, tool bits 90-130 are arranged in a first grouping and are individually rotatable about a first rotation axis 72 defined by shaft 70. Tool bits 140-180 form a second grouping and are individually rotatable about a second rotation axis 74 defined by shaft 80. Each tool bit 90-180 is rotatable between a stowed position and a use position. In the stowed position, the tool bits 90-180 may reside within the footprint of support 30 and extend toward the opposing shaft 70, 80. In other words, tool bits 90-130 extend toward shaft 80 in the stowed position, while tool bits 140-180 may extend toward shaft 70 when in the stowed position. In the use position, the tool bits 90-180 may extend outside of the footprint of support 30, i.e., extend outside of the periphery of support 30. Tool bits 90-130 may be used as typical multi-tool bits which may not be associated with torque-indicating capabilities. However, any of tool bits 140-180 may be used as both typical multi-tool bits as well as being torqued to specific torque settings between a minimum torque setting (e.g., 2 Nm) and a maximum torque setting (e.g., 10 Nm).

The spring 50 included in tool 10 is a leaf spring that is coupled to the pair of supports 20, 30, and operatively coupled to tool bits 140-180. In this respect, the spring includes a first end portion 56 that is moveable relative to the pair of supports 20, 30 between a neutral position and a torqued position in response to a rotational force being imparted on the mechanical fastener by the tool bit. In other words, when torque is applied to any of tool bits 140-180 in the second grouping, spring 50 may be forced to elastically bend, with the displacement of the spring 50 being used to identify a specific torque setting. Along these lines, the position of slider 60 relative to the spring 50 may change the effective spring rate of the spring 50, and thus, may also change the required force to achieve a predetermined displacement distance of the spring 50.

As the first end portion 56 moves from the neutral position toward the torqued position, the first end portion 56 moves toward support 30 and away from support 20. Conversely, as the first end portion 56 moves from the torqued position toward the neutral position, the first end portion moves toward support 20 and away from support 30. The spring 50 also assumes a generally planar configuration when in the neutral position, and a bent or arcuate configuration when in the torqued position.

Supports 20 and 30 may be made of a material such as aluminum or other material that is suitably stiff and strong and can be made from various methods such as forging, machining, or die casting. Spring 50 may be made of carbon fiber or other material such as spring steel that is stiff and has good spring characteristics such that the spring 50 may be capable of bending within the limits of the mechanism without permanent deformation. Tool bits 90-180 can be steel or other suitably strong material and can be made with forging, investment casting, forming, or other suitable process. The slider 60 may be made of fiber filled injection molded polymer such as glass filled Nylon, but could be made of various suitable materials including metals. Shafts 70 and 80 and screws 190-220 are made of steel but could be made of other suitable materials such as aluminum.

Tool 10 may be manufactured for very little extra cost and size compared to a standard multi-tool, yet may offer a compelling advantage to be able to accurately tighten fasteners to various specified torque values.

Figure 3:
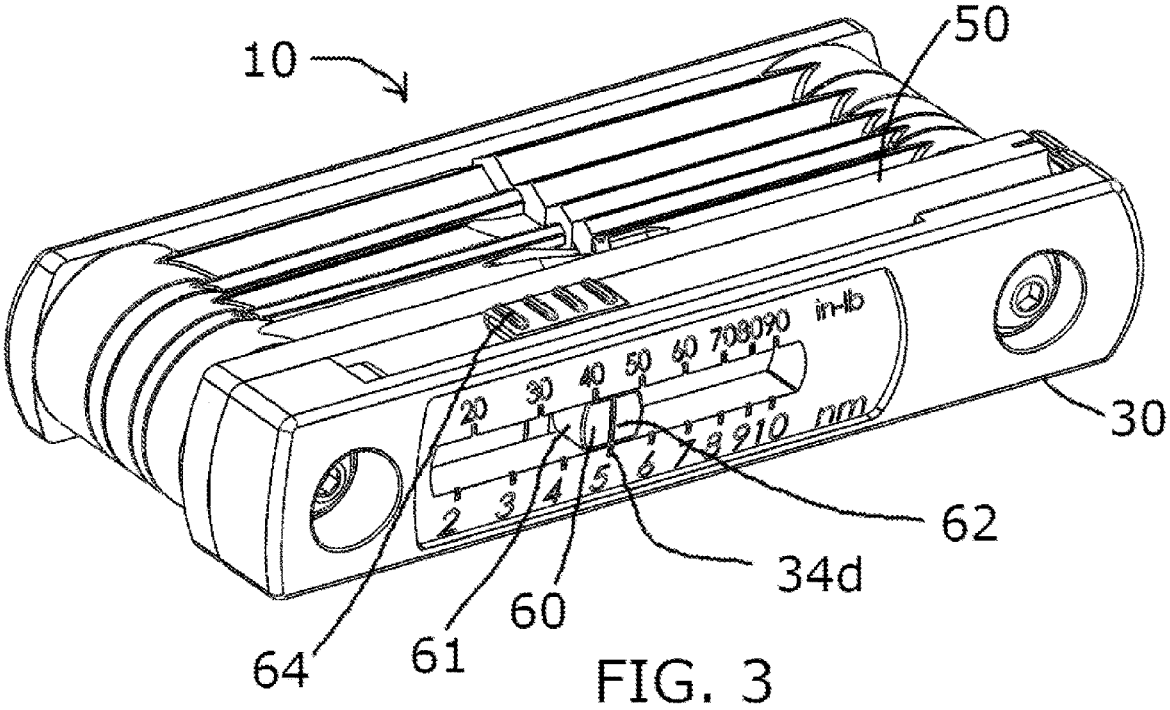
FIG. 3 is a perspective view of the first embodiment of torque indicating multi-tool set to 5 Nm.

FIG. 3 shows tool 10 with the slider 60 in the 5 Nm torque setting. In this setting, slider 60 indicator line 62 is aligned with support 30 indicator line 34*d*.

Figure 4:
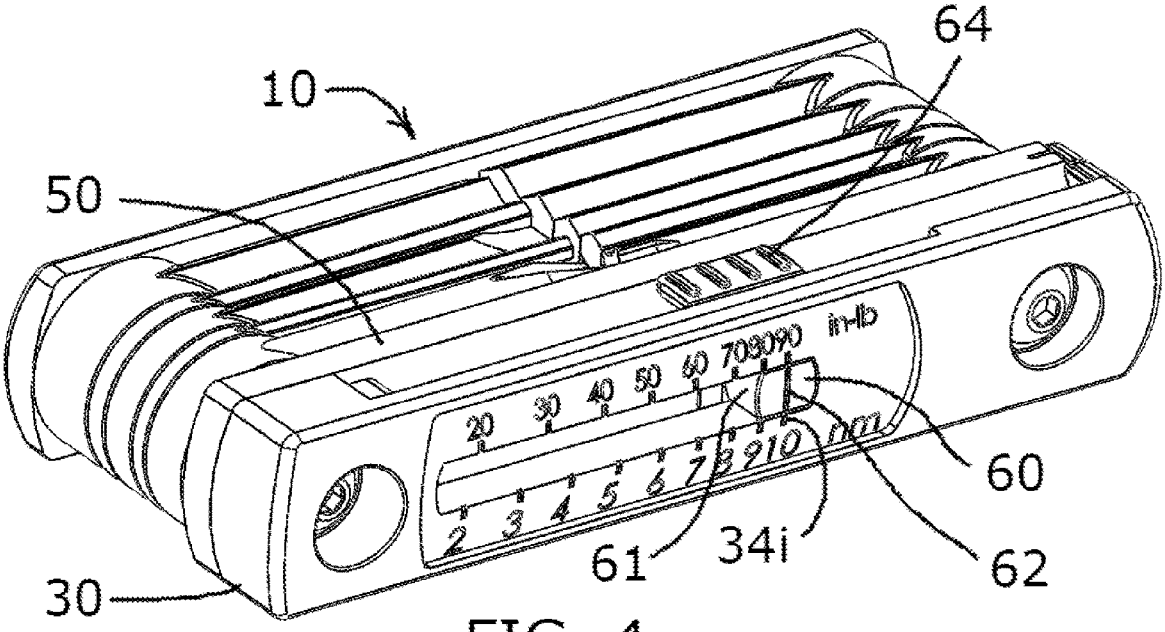
FIG. 4 is a perspective view of the first embodiment of torque indicating multi-tool set to 10 Nm.

FIG. 4 shows tool 10 with the slider 60 in the 10 Nm torque setting. In this setting, slider 60 indicator line 62 is aligned with support 30 indicator line 34*i*. Note that as the slider 60 moves from position 34*a* towards 34*i*, the portion of spring 50 that is allowed to bend becomes shorter and thus increases in spring rate. Conversely, as slider 60 moves from position 34*i* toward position 34*a*, the portion of the spring 50 that is allowed to bend becomes longer, and thus decreases the spring rate.

Figure 5:
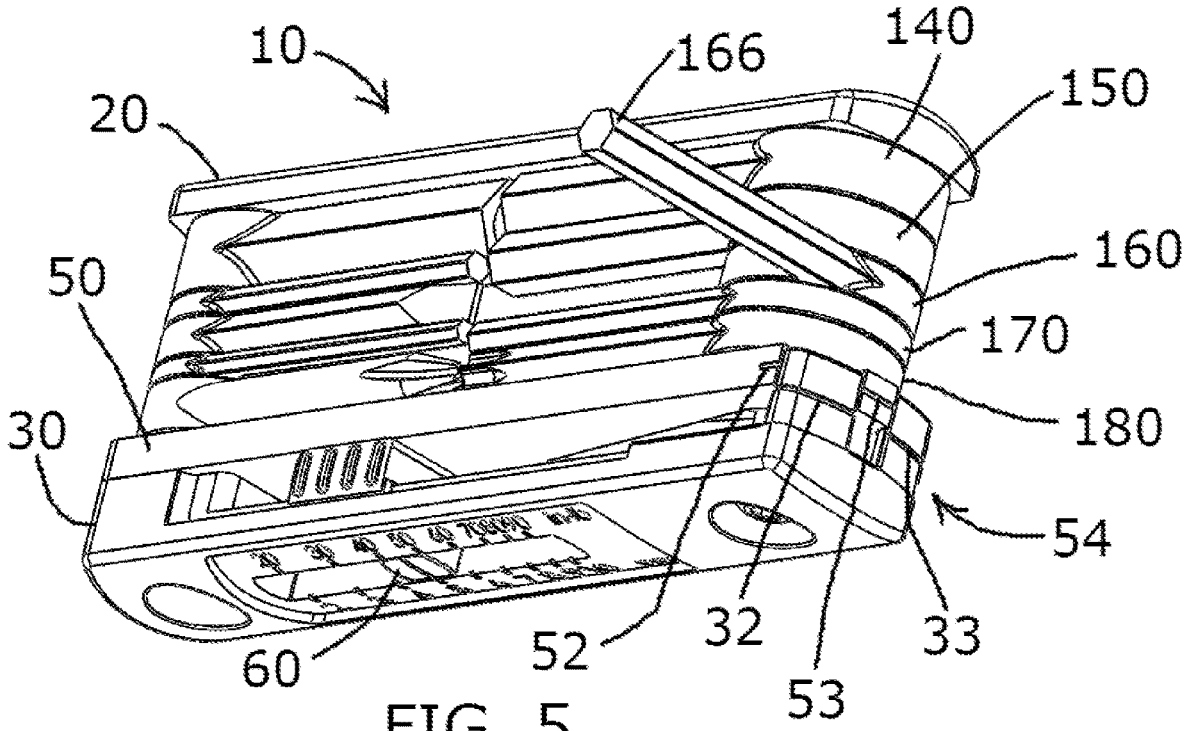
FIG. 5 is a perspective view of the first embodiment of torque indicating multi-tool set to 5 Nm and with one of the tools rotated 90 degrees from stored position and ready to tighten a fastener.

FIG. 5 shows tool 10 with tool bit 160 transitioned to a use position, and the slider 60 set to 5 Nm. Alternatively, the torque setting could be ignored and tool 10 may be used to tighten or loosen a fastener as with any typical multi-tool. Spring 50 may include indicator lines 52, 53, and 54, which may be projections, recesses, or printed indicia or markings formed on the spring 50. Support 30 has indicator lines 32 and 33. In the position depicted in FIG. 5, spring 50 indicator lines 52-54 do not align with support 30 indicator lines 32 and 33 because there is not yet torque applied to tool bit 160. The bias of spring 50 causes tool bits 140-180 to maintain contact with each other and up against support 20 while allowing rotation from a stored position shown in FIG. 1 to a ready to use position shown in FIGS. 5-6.

Figure 6:
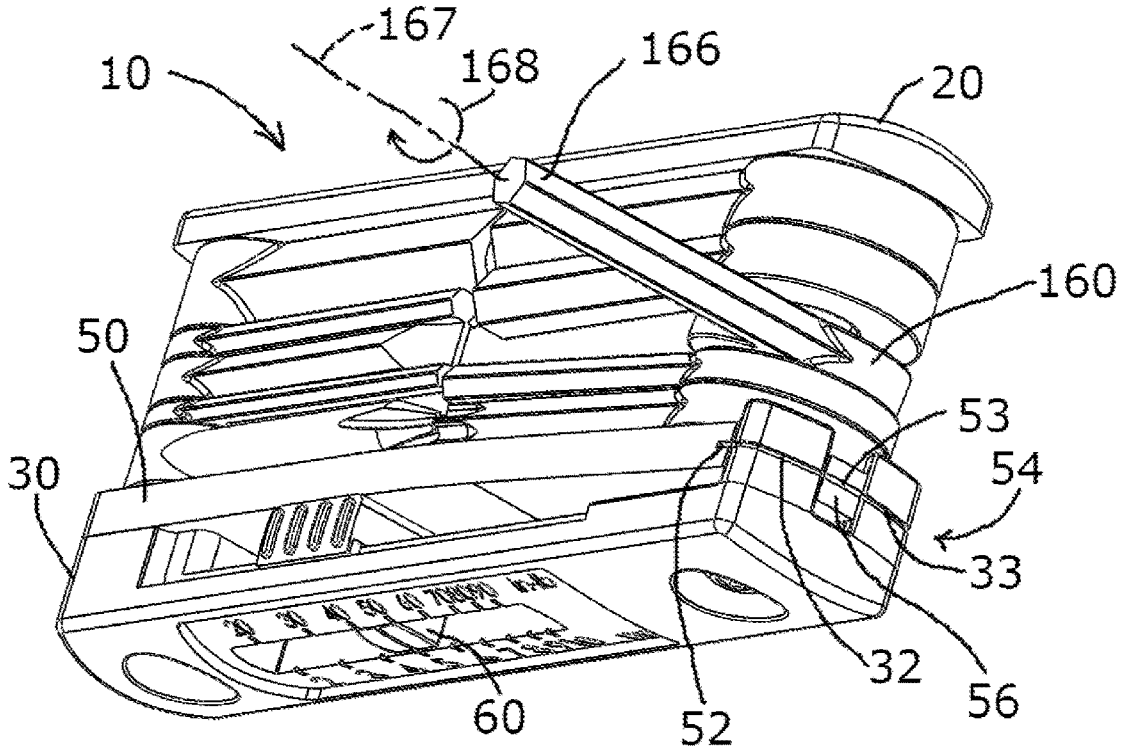
FIG. 6 is a perspective view of the tool shown in FIG. 5 tightening a fastener (not shown) to 5 Nm.

FIG. 6 shows tool 10 tool bit 160 deployed in a use position for engagement with a fastener (not shown). The slider 60 is moved relative to the support 30 and spring 50 for tightening the fastener to 5 Nm. The tip 166 of tool bit 160 may be inserted into a complementary-shaped recess formed in a fastener along an engagement axis 167 while a user imparts a force on the tool 10 so as to urge tip 166 to rotate about engagement axis 167 in a clockwise direction, as shown by the arrow 168. This action may cause tool bit 160 to pivot so as to become offset relative to adjacent tool bits 150 and 170, forcing tool bits 150 and 170 to move apart. The movement of tool bits 150, 170 away from each other may cause spring 50 to bend, resulting in the end 56 of spring 50 moving away from support 20, and toward support 30.

The magnitude of the distance that spring end portion 56 moves away from support 20 may depend on the magnitude torque applied to tool bit 160 and the stiffness of spring 50. The stiffness of spring 50 may depend on the material, the dimensions, and on the effective length X (see FIG. 12), i.e., that portion of spring 50 that is allowed to bend. The effective length X depends on the position of slider 60, since the portion of the spring 50 that is allowed to bend is defined on one end by the slider 60. As the slider 60 moves away from spring end 56, the effective length X increases, and conversely, as the slider moves toward spring end 56, the effective length X decreases. For example, spring 50 is stiffer and has a shorter effective length X when indicator line 62 of slider 60 is aligned with the 5 Nm indicator line 34*d* of support 30, than if indicator line 62 is aligned with the 2 Nm line 34*a*, as shown in FIG. 1. Spring 50 is twice as stiff when the slider 60 is set at 4 Nm, than when slider 60 is set at 2 Nm, and 5 times as stiff when the slider 60 is set at 10 Nm, than when the sider 60 is set at 2 Nm. With slider 60 positioned as shown in FIG. 6 on the 5 Nm indicator line 34*d*, it requires 5 Nm for spring 50 to bend enough for indicator lines 52-54 on spring 50 to align with indicator lines 32, 33 on support 30. For convenience, alignment of indicator line 52 to indicator line 32 can be viewed from the top (e.g., a first perspective), alignment of indictor lines 32 and 33 to indicator line 53 can be viewed from the end (e.g., a second perspective), and alignment of indicator line 33 to indicator line 54 can be viewed from the bottom (e.g., a third perspective). In this way, the user may visually perceive when they have achieved 5 Nm of torque.

Any of tool bits 140, 150, 160, 170, 180 may be useable in a similar manner which allows for indication of torque. Therefore, multi-tool tool 10 may be assembled with tool bits 140-180 that are most commonly used for tightening fasteners that require a torque specification, such as fasteners on a car or bicycle. Note that if it was desired to tighten a fastener to a specific torque value with a tool bit that is not located among tool bits 140-180, then an appropriate tool bit could be adapted (with a socket, for example) to any of the tool bits that are on the torque end. As such, the torque indicating multi-tool 10 may be used to torque a wide variety of fasteners in a wide variety of applications. Tool bits 140-180 may also be used for general tightening and loosening rather than specific torque amounts simply by ignoring the position of slider 60 and the alignment of all indicating lines.

While FIG. 6 shows that 5 Nm of torque has been reached, if slider 60 were positioned differently, alignment of the slider 60 with other values on the scale would represent other torque values. In fact, in the exemplary tool 10, there are two scales of torque values, namely, one scale for torque in Nm and the other scale for torque in in-lb. This may be particularly convenient for users that may work on devices that have metric versus imperial torque requirements. Furthermore, if a fastener has a torque requirement that is between two whole numbers, 4.5 Nm for example, then placing slider 60 indicator line about halfway between 4 Nm indicator line 34*c* and 5 Nm indicator line 34*d* will allow tightening very close to the required torque. It may also be possible to add finer gradation indicator lines as well to assist in fractional torque values.

Figure 7:
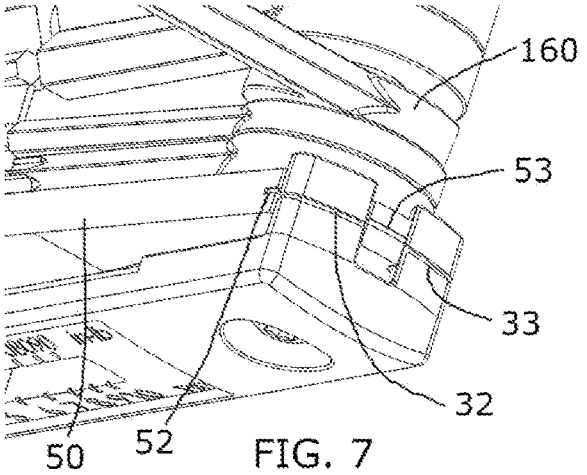
FIG. 7 is a partial perspective view of the tool shown in FIG. 6, but torqued below 5 Nm.
Figure 8:
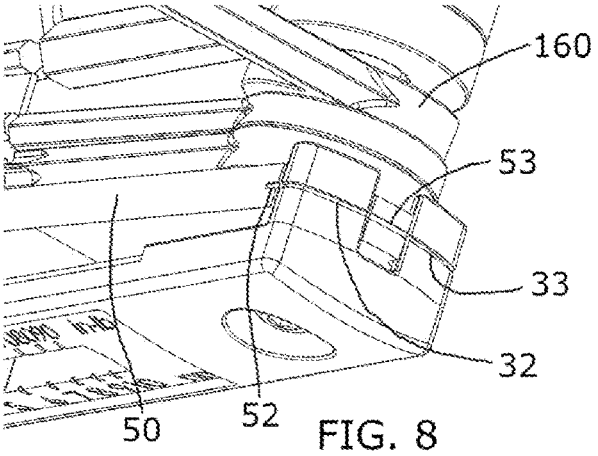
FIG. 8 is a partial perspective view of the tool shown in FIG. 6 and torqued correctly to 5 Nm.
Figure 9:
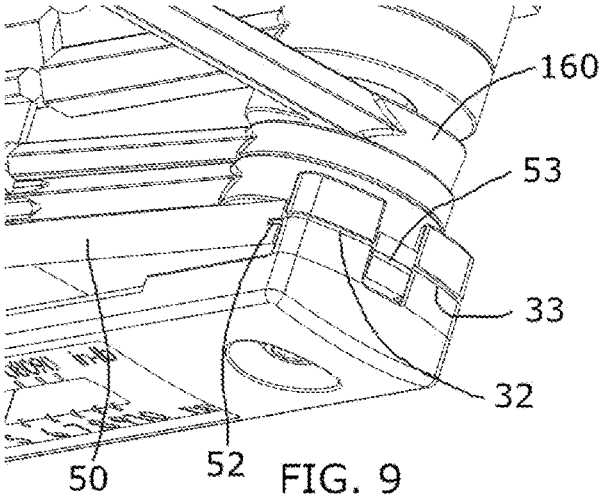
FIG. 9 is a partial perspective view of the tool shown in FIG. 6, but torqued above 5 Nm.
Figure 10:
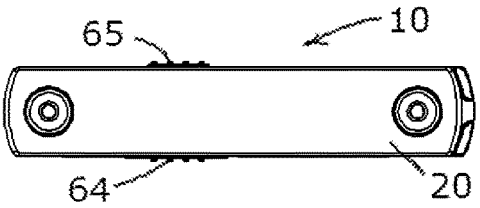
FIG. 10 is a side view of the first embodiment of torque indicating multi-tool.
Figure 11:
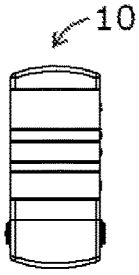
FIG. 11 is an end view of the first embodiment of torque indicating multi-tool.

FIGS. 7-9 show different positions of the indicator lines 52, 53 on spring 50 relative to indicator lines 32, 33 on support 30. In particular, FIG. 7 shows that spring 50 has not bent far enough yet for indicator lines 52, 53 to be aligned with indicator lines 32, 33. Therefore, the torque is below the preset torque setting, e.g., 5 Nm. FIG. 8 shows ideal alignment, similar to FIG. 6, indicating that (in this example) 5 Nm has been reached. FIG. 9 shows that more than 5 Nm of torque is being applied because indicator lines 52, 53 are shown beyond indicator lines 32, 33. The use of the indicator lines 52, 53 on the spring 50 and the corresponding indicator lines 32, 33 on support may allow a user to easily identify when alignment is correct, as the human eye and brain are extremely good at identifying when two thin lines are aligned or not. With the arrangement of indicator lines as shown, alignment can be viewed from different angles, making it easier to see if the desired torque level has been achieved.

FIGS. 10-13 show various views of torque indicating multi-tool 10. It can be seen that as slider 60 is repositioned, the effective length X changes which changes spring stiffness. Note that in order to have a significant range of torque values, the stiffness of spring 50 may be required to vary significantly. For example, the stiffness of spring 50 at 10 Nm must be 5 times higher than the stiffness at 2 Nm. The mechanism shown allows a non-linear spring rate change so that in a relatively short movement of slider 60, a wide variety of spring rates may be achieved. In general, a beam in bending may become twice as stiff at half its length, and 4 times as stiff at a quarter of its length. This means that if spring 50 were a solid beam, the indicating lines 34*a-i* and 35*a-h* would become increasingly closer together as the effective length X was reduced. If the lines become too close together, accuracy may suffer because any error in positioning slider 60 may be magnified. However, this issue may be addressed by making the distances between indicator lines more consistent by removing material from spring 50 in the way shown in FIGS. 22 and 23 to form a slot 57 in spring 50. The removal of material may allow causes indicating lines associated with higher torque magnitudes to become more spaced apart than they otherwise would be. Tool 10 may have a torque indicating range between 2 and 10 Nm; however, a larger multi-tool may have a larger torque range. The torque range may also depend on the characteristics of the spring 50, such that the torque values may be varied by changing the properties of the spring 50.

FIGS. 14-16 and 20 show in detail the torque indication tool 10 when no torque is applied. Indicator surface 31 may be implemented on support 30 in various ways. In one implementation, the numbers and indicator lines may be laser etched onto support, although it is also contemplated that the numbers and indicator lines may be pad printed or applied as a decal or through other known methods. The Newton-meter scale includes indicator lines 34*a*-34*i* for settings between 2 and 10 Nm. The inch-pound scale includes indicator lines 35*a*-35*h* for settings between 20 and 90 in-lb. The units and torque magnitudes are exemplary, and are not intended to limit the scope of the present disclosure. The torque indicating setting depends on the locating indicator line 62 of slider 60 in alignment with one of indicator lines 34*a*-34*i* and 35*a*-35*h*. Slider 60 may be moved relative to support 30 by using grip surfaces 64, 65 on slider 60.

Figure 16:
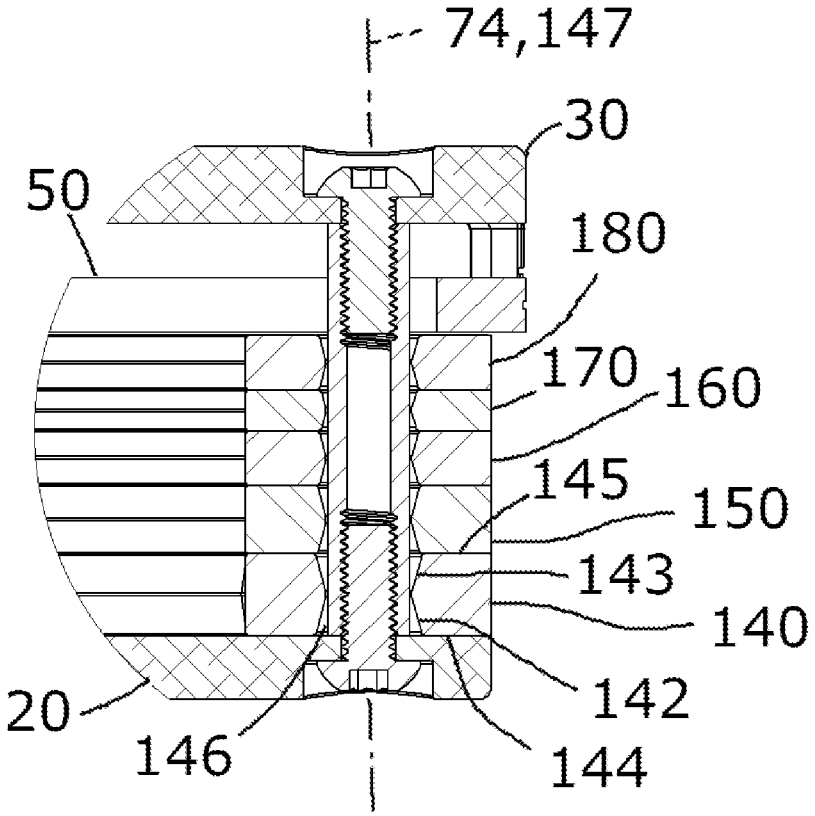
FIG. 16 is a close up view of FIG. 15.

As shown in FIG. 16, tool bit 140 may include inner angled surfaces 142, 143 and opposed outer surfaces 144, 145, and an opening 146 extending between the opposed outer surfaces 144, 145. The inner angled surfaces 142, 143 may result in the opening 146 disposed about central axis 147, with the opening 146 having a variable diameter, wherein a minimum diameter is defined at an approximate midpoint between the outer surfaces 144, 145, and a maximum diameter may be defined adjacent each of the outer surfaces 144, 145. The minimum diameter may be slightly larger than the outer diameter of shaft 80, to allow the tool bit 140 to rotate between the stowed position and the use position. The maximum diameter is larger than the minimum diameter to create spaced for allowing the tool bit 140 to become angled relative to the support 20 and adjacent tool bit 150, when a torque is applied. When no torque is applied, the central axis 147 of opening 146 may be coaxially aligned with rotational axis 74. However, when a torque is applied to tool bit 140, the central axis 147 may be offset from rotational axis 74.

Figure 19:
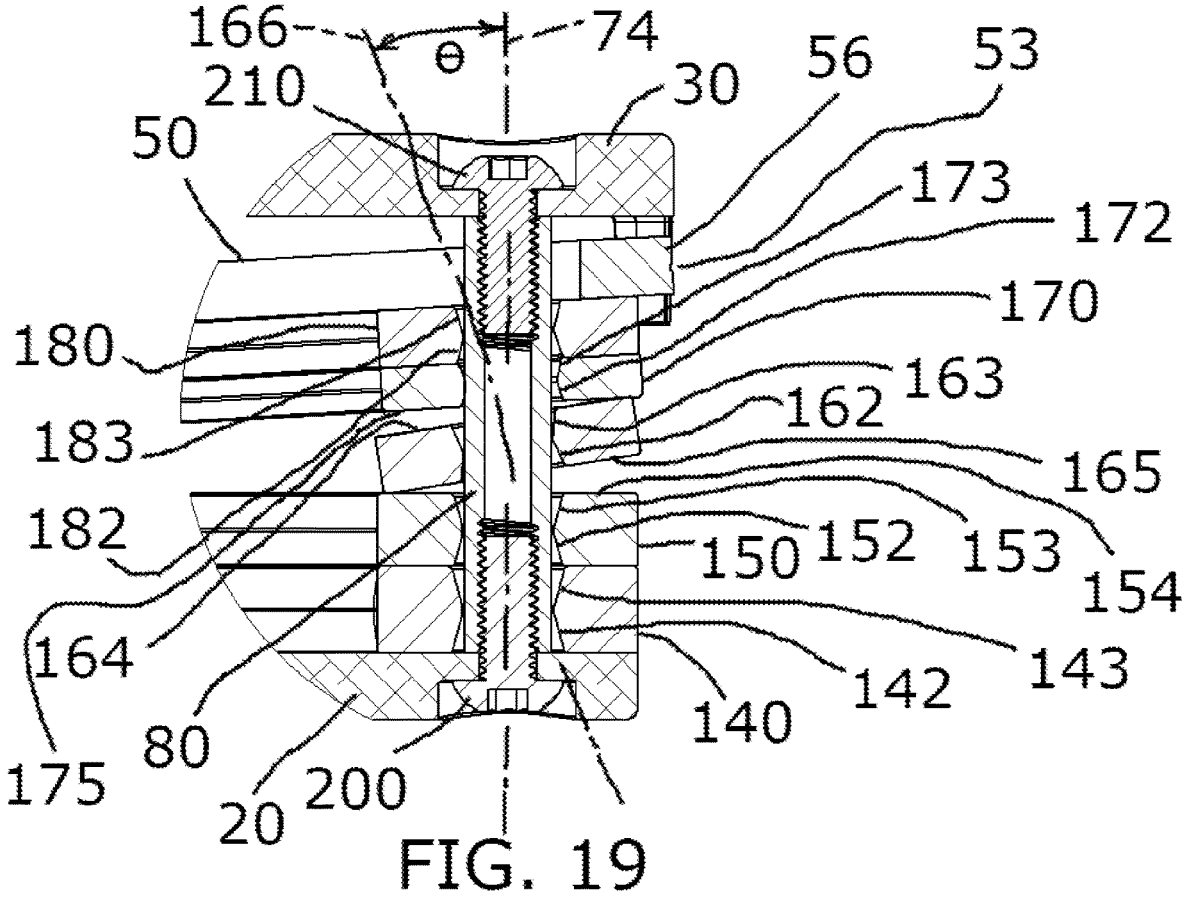
FIG. 19 is a close up view of FIG. 18.
Figure 20:
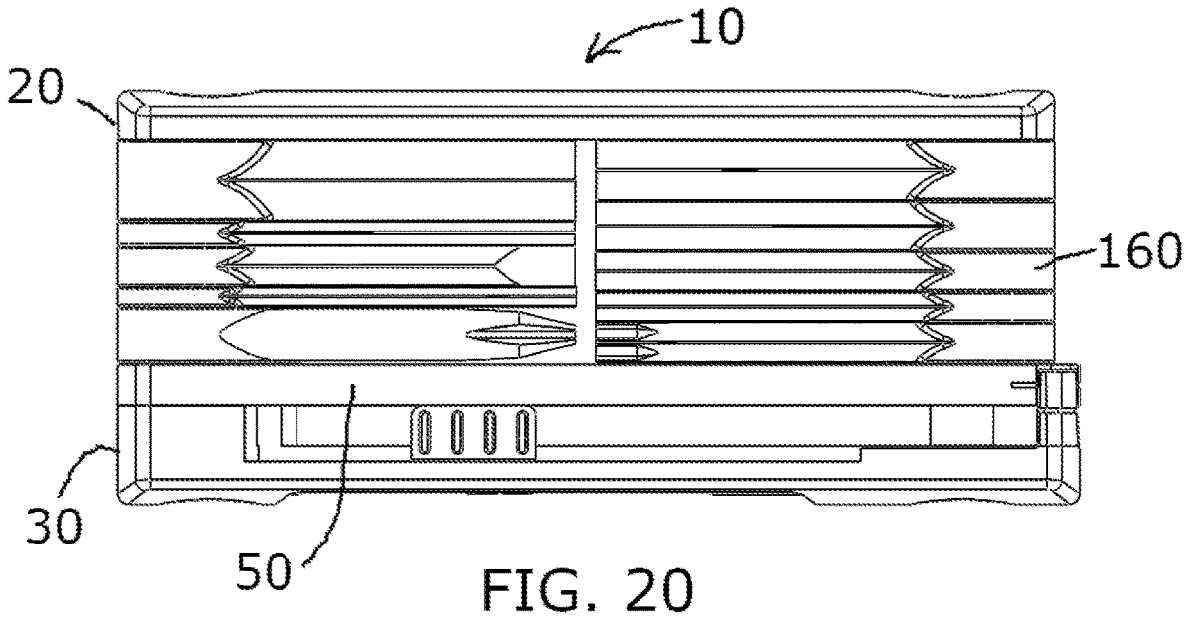
FIG. 20 is a top view of the first embodiment of torque indicating multi-tool in its relaxed position.

Although the foregoing describes the particular structure of tool bit 140, it is contemplated that tool bits 150, 160, 170, 180 may have similar structural features, as shown in FIG. 19. These angled surfaces allow the tool bits 140-180 to each be able to twist perpendicular to the centerline axis of shaft 80, i.e., the rotation axis 74, yet tool bits 140-180 are still relatively aligned concentrically when not being torqued and can be rotated from a stored position to a ready position.

Figure 17:
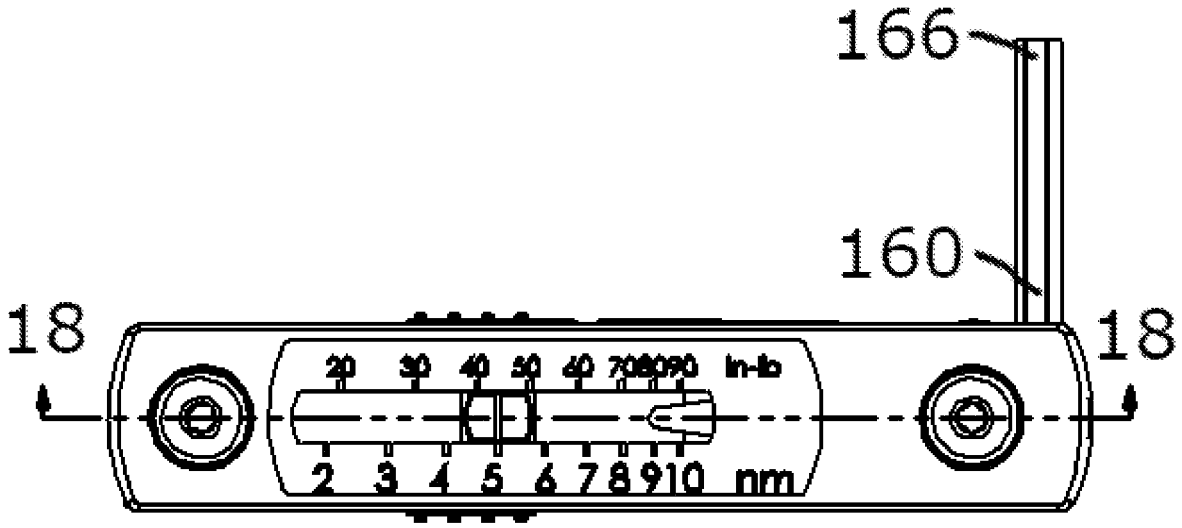
FIG. 17 is a side view of the first embodiment of torque indicating multi-tool with one of the tools rotated 90 degrees from stored position and tightening a fastener top 5 Nm.
Figure 18:
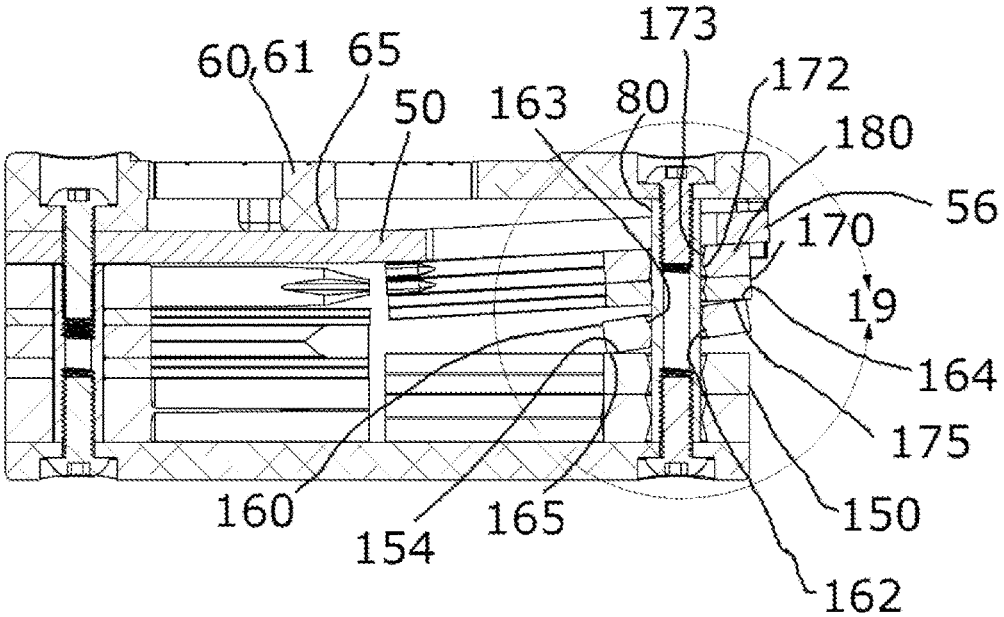
FIG. 18 is a section view of FIG. 17.
Figure 21:
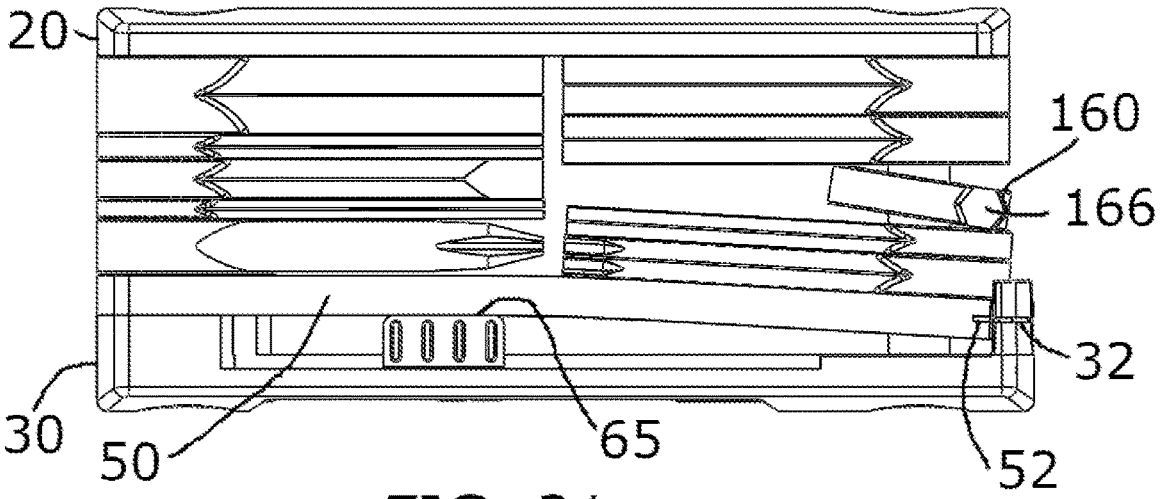
FIG. 21 is a top view of the first embodiment of torque indicating multi-tool tightening a fastener to 5 Nm.

FIG. 17 shows tool 10 set to 5 Nm of torque, with FIGS. 18-19 and 21 showing the tool 10 with 5 Nm of torque applied to tool bit 160 tip 166. The application of the torque causes tool bit 160 to pivot perpendicular to the rotation axis 74, which causes central axis 166 of tool bit 160 to become angled relative to rotation axis 74 by a magnitude, Θ, which pushes apart tool bits 150 and 170. Specifically, the torque causes end surface 165 of tool bit 160 to push against end surface 154 of tool bit 150, and for end surface 164 of tool bit 160 to push against end surface 175 of tool bit 170. Being that tool bits 150, 140 are abutted against support 20, the pivotal motion of tool bit 160 displaces tool bits 170,180, and spring end 56 toward support 30. The spring rate of spring 50 depends on the effective length X, which is dependent on the linear location of slider surface 65 on spring 50. As X becomes shorter, the spring rate of spring 50 increases. As shown in FIGS. 17-19 with slider 60 in the 5 Nm setting, a torque of 5 Nm is required to bend spring 50 enough to align indicator lines 52 with 32, and 53 with 32 and 32, and 33 with 54. While torque is shown in the Figures as being applied to tool bit 160, it is understood that the use of tool bit 160 is only an example, and that torque may be applied to any of the tools 140-180 to achieve the same result of aligning indicator lines 32, 33, 52, 53, and 54 when the specified torque is applied.

Figure 22:
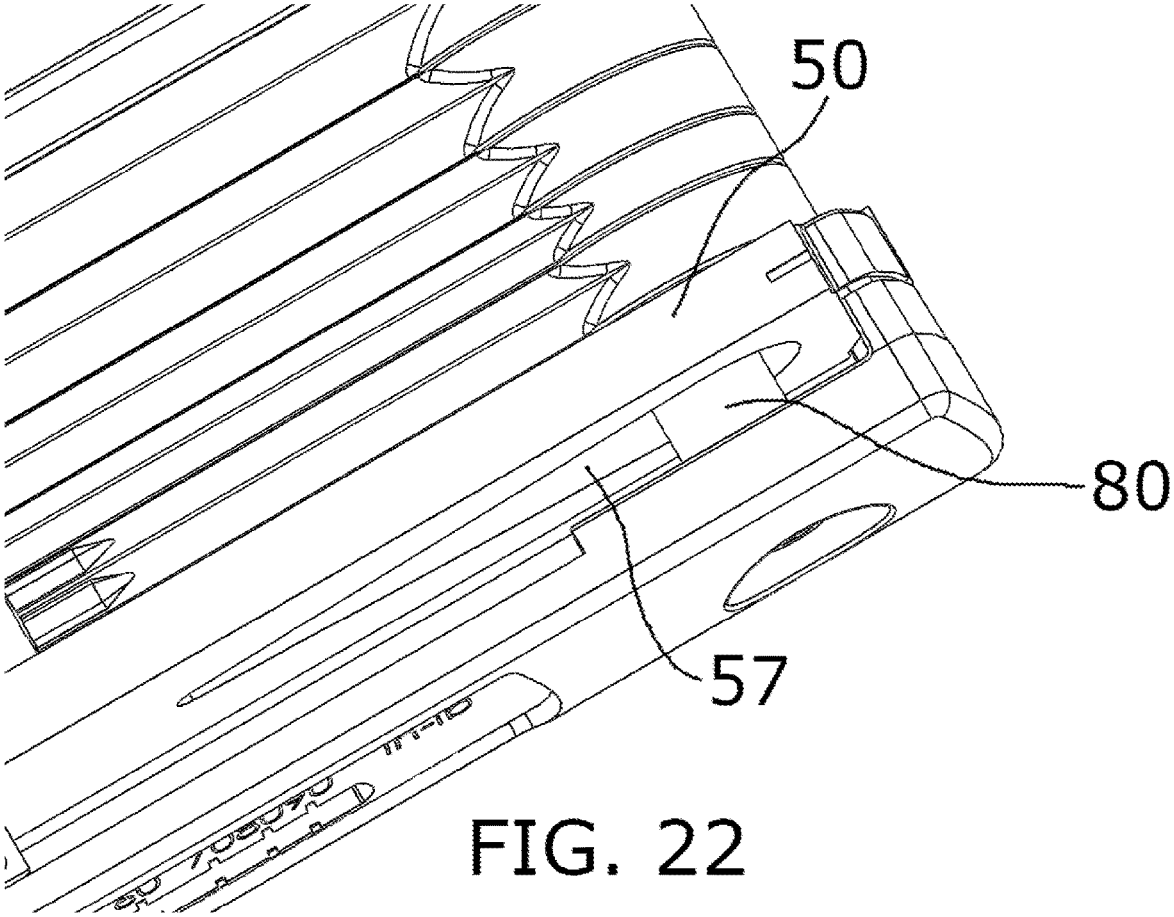
FIG. 22 is a close up 3D view of the first embodiment of torque indicating multi-tool.
Figure 23:
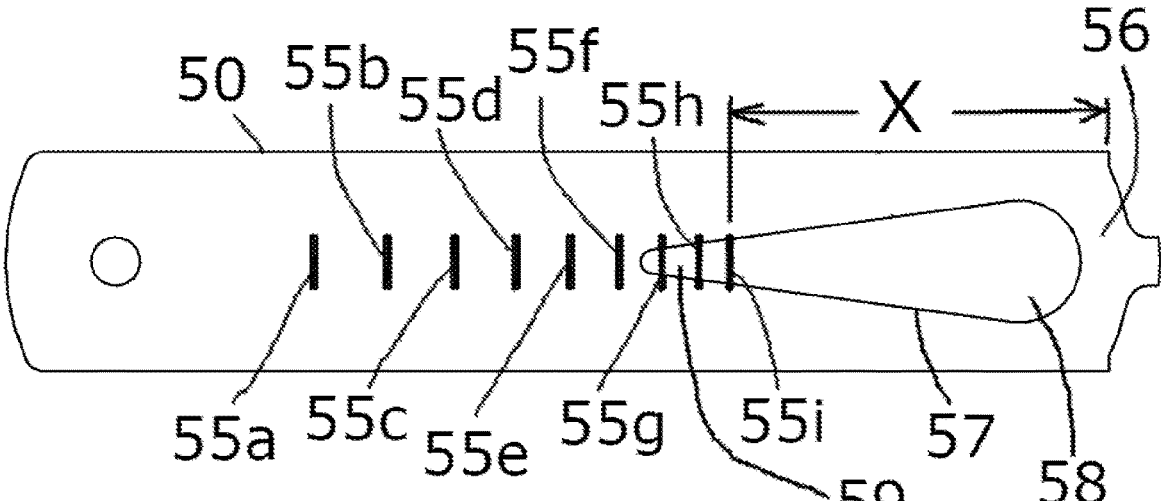
FIG. 23 is a side view of a spring.

FIGS. 22 and 23 more specifically depict slot 57 formed in spring 50. In order for spring 50 to flex, clearance may be required between the slot 57 and shaft 80. Furthermore, slot 57 may be elongated to affect the spring rate of spring 50 depending on the location of slider 60, particularly at the higher torque settings. The slot 57 may include an enlarged end potion 58 sized to receive shaft 80, and a tapered end portion 59, which decreases in width as the slot 57 extends away from the enlarged end portion 58. Without the elongated shape of slot 57, surface locations 55*g*, 55*h*, and 55*i* would be slightly closer together than shown. Surface locations 55*a*-55*i* represent where surface 65 of slider 60 supports spring 50 and thus represents the bending effective length X. Tool 10 may still work, even if surface locations 55*g*, 55*h*, and 55*i* are closer together but it is easier for the user to accurately adjust slider 60 to the desired location when the surface locations are farther apart.

Figure 24:
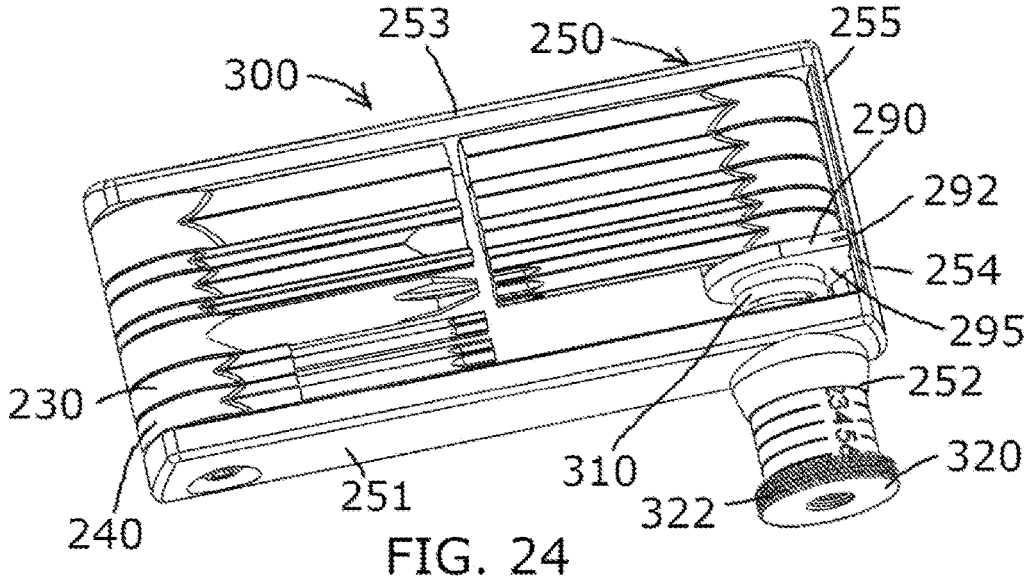
FIG. 24 is a 3D view of a second embodiment of torque indicating multi-tool set to 2 Nm.
Figure 25:
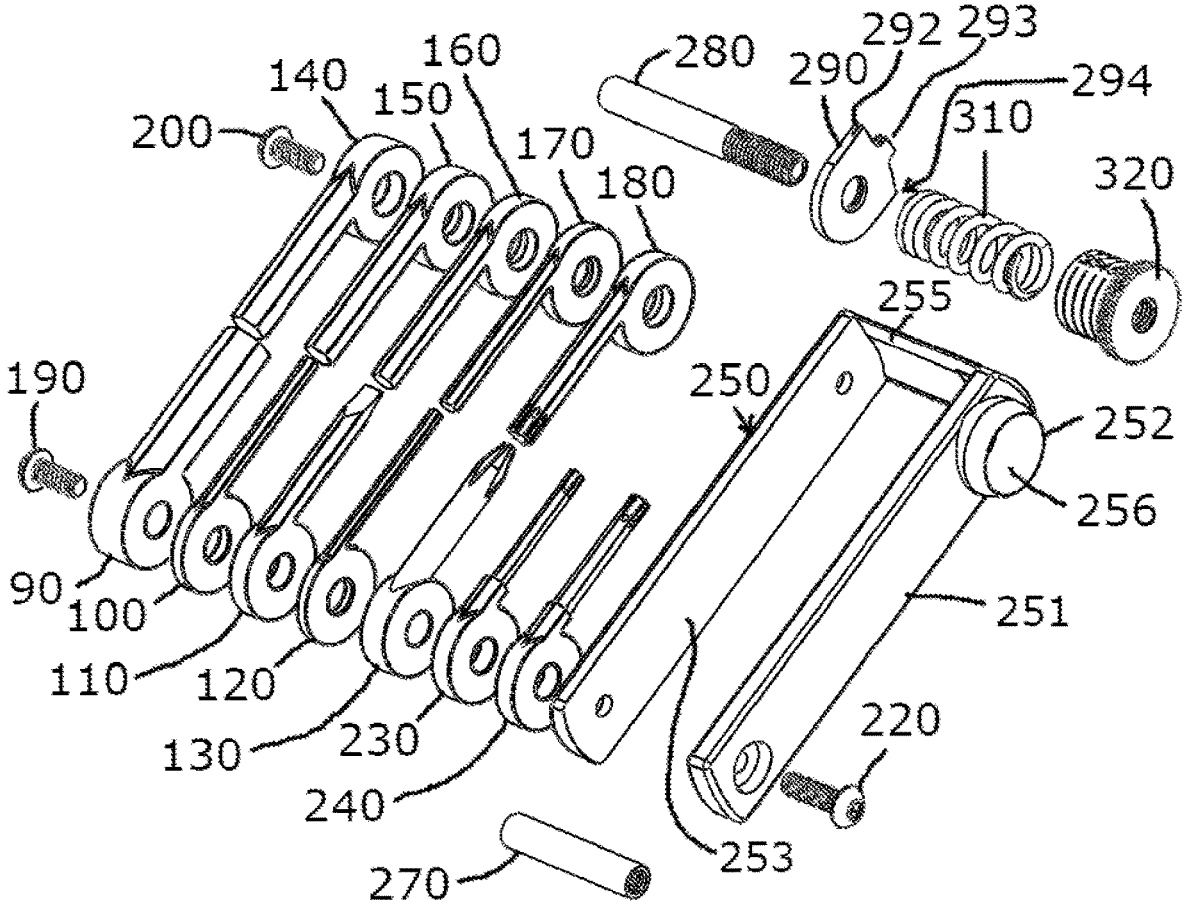
FIG. 25 is an exploded view of the second embodiment of torque indicating multi-tool.

Referring now to, FIGS. 24 and 25, there is depicted an alternate embodiment of torque indicating multi-tool 300. The primary difference is that tool 300 uses a coil spring 310 instead of the leaf spring 50 used in tool 10. Tool 300 is generally comprised of a plurality of tool bits 90-180 and additionally tool bits 230, 240, screws 190, 200, 220, support unit 250, shafts 270, 280, an indicator plate 290, the spring 310, and an adjustment dial 320. Support unit 250 may be comprised of opposed supports 251, 253, which may be connected by end plate 255. Similar materials and manufacturing processes are used for similar components of tool 300. Coil spring 310 may be made of steel or other materials known in the art. Support unit 250 may be made in various ways such as die casting, forging, extruding, machining, and injection molding.

Support 251 may include an opening 256 formed therein, which may be aligned with shaft 280, indicator plate 290, spring 310, and adjustment dial 320, with portions of the shaft 280, spring 310, and adjustment dial 320 extending into through the opening 256. End plate 255 may include a slot or opening 257 (see FIG. 28) sized to receive an end of indicator plate 290, with indicator plate 290 being moveable along opening 257.

The size of tool 300 shown may be similar to that of tool 10 except where adjustment dial 320 may protrude as shown. Furthermore, tool 300 may include additional tool bits, such as tool bits 230, 240. As such, the overall efficiency of tools to size may be similar as configured. Note that when not using the torque indicating function, adjustment dial 320 may be screwed all the way in to the maximum torque position, which reduces the overall size of tool 300 during use that does not require specific torque values. Another difference between tool 10 and 300, may be that tool 10 can indicate up to 10 Nm, whereas tool 300 may only be capable of indicating up to a smaller torque, such as approximately 6 Nm. However, by either increasing the length of indicating dial 320 or by modifying spring 310, a greater torque range may be achieved. As shown in FIG. 24, tool 300 is set for a torque of 2 Nm because edge 252 is aligned with indicator line 324*a*.

Figure 26:
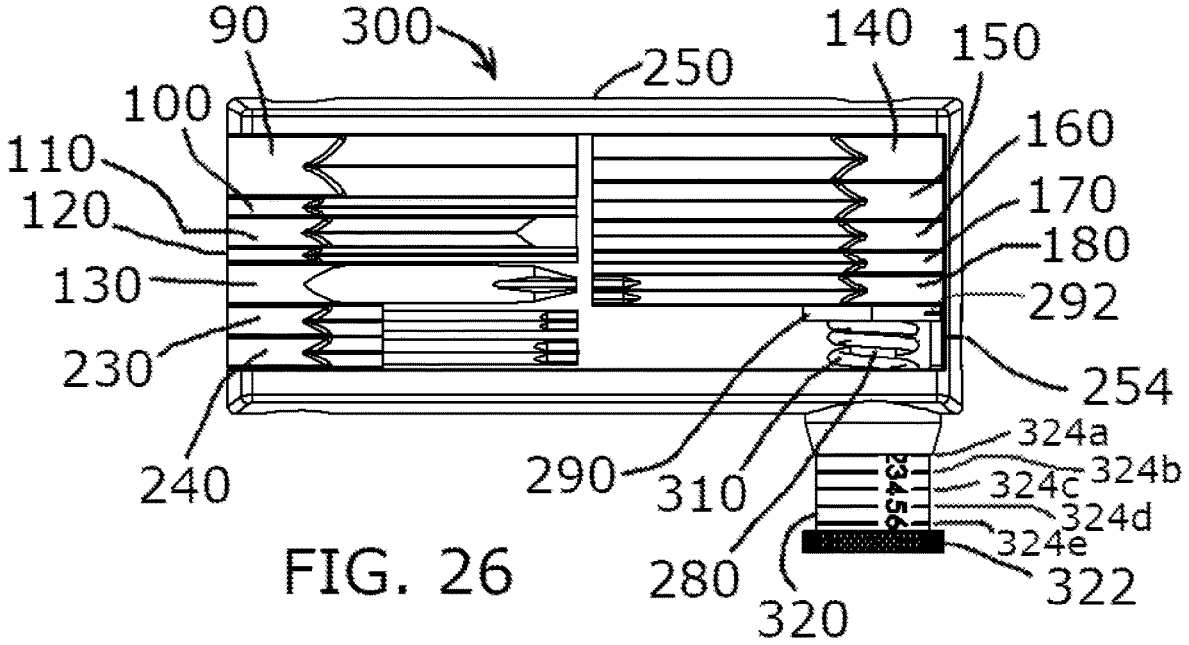
FIG. 26 is a top view of the second embodiment of torque indicating multi-tool.
Figure 27:
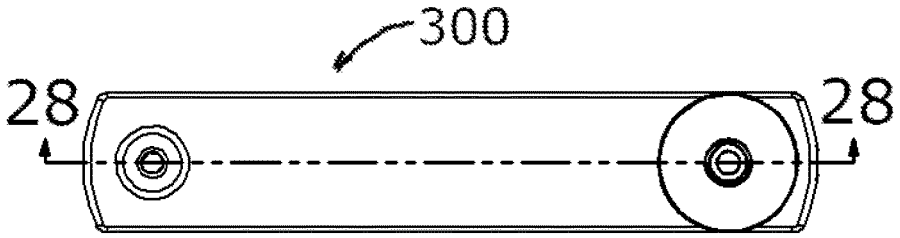
FIG. 27 is a side view of the second embodiment of torque indicating multi-tool.
Figure 28:
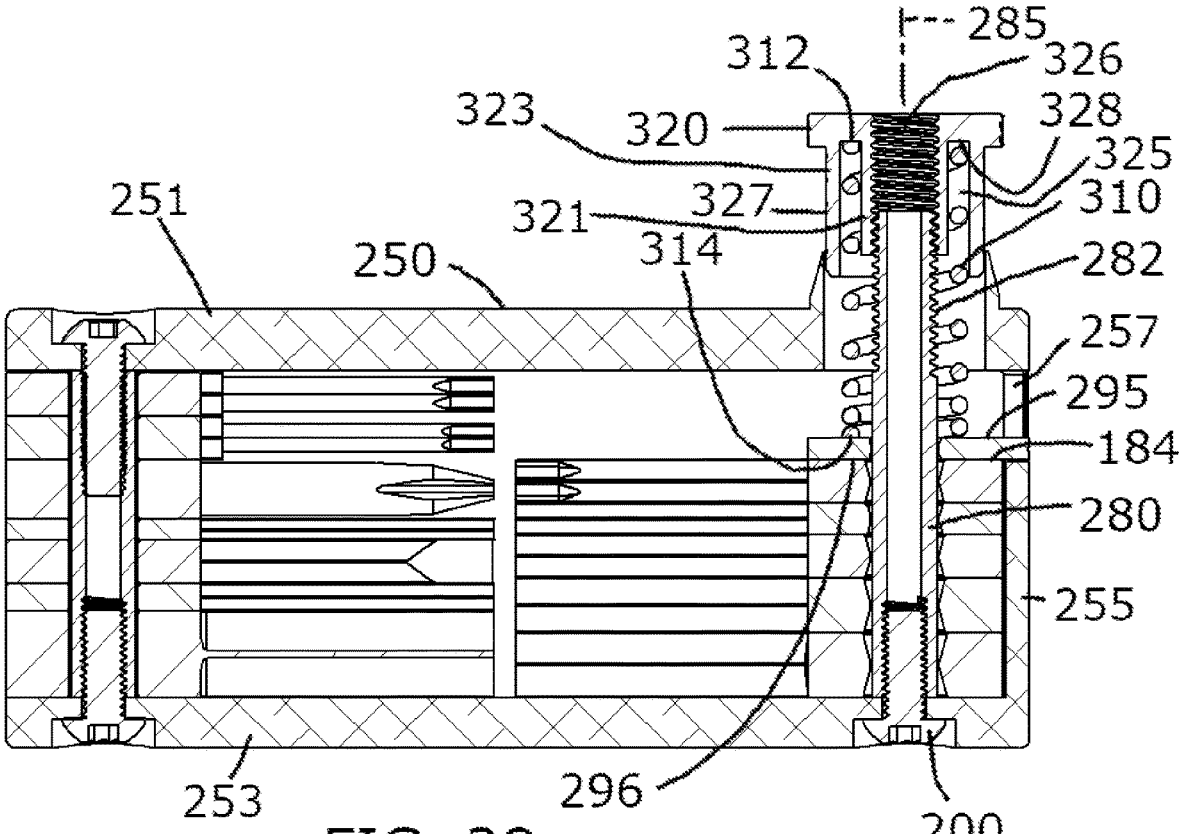
FIG. 28 is a section view of the second embodiment of torque indicating multi-tool.

FIGS. 26-28 show that on one end, spring 310 may include end surface 312 which may push against surface 328 of adjustment dial 320. In this regard, the adjustment dial 320 may include inner cylindrical wall 321, an outer cylindrical wall 323, and an inner annular channel 325 formed therebetween, with the inner annular channel 325 being sized to receive a portion of the spring. The spring 310 may additionally include surface 314, which may push against surface 295 of indicator plate 290. When adjustment dial 320 is turned, thread 326 formed on the inner surface of inner annular channel 325 of dial adjustment 320 engages with thread 282 of shaft 280, which may transfer relative rotation therebetween into translation of adjustment dial 320 relative to the shaft 820. Such translation may result in the distance between surface 328 and surface 295 to change, which changes the load created by spring 310. When, for example, adjustment dial 320 is adjusted to the 2 Nm setting as shown in FIGS. 26 and 28, approximately 2 Nm of torque may be required to be imparted on any of the tool bits 140 to 180 to cause indicator lines 292, 293, 294 on indicator plate 290 to move into alignment with indicator line 254 of support 250. Indicator dial 320 has indicator lines 324*a-e* for adjusting the force required to achieve 2-6 Nm of torque, respectively, by aligning one of indicator lines 324*a-e* with edge 252 of support 250. Indicator dial 320 may include a grip surface 322 for improved ease of turning. Surface 296 of indicator plate 290 may push against surface 184 of tool bit 180. When torque is applied to any of tool bits 140-180, spring 310 may become more compressed through pivotal motion of the tool bits 140-180, as described in more detail above. In this regard, tool bits 140-180 may rotate about a rotation axis 285 defined by shaft 280, and also pivot about an axis offset from rotation axis 285 to cause movement of the indicator plate 290 relative to the support 251.

Figure 29:
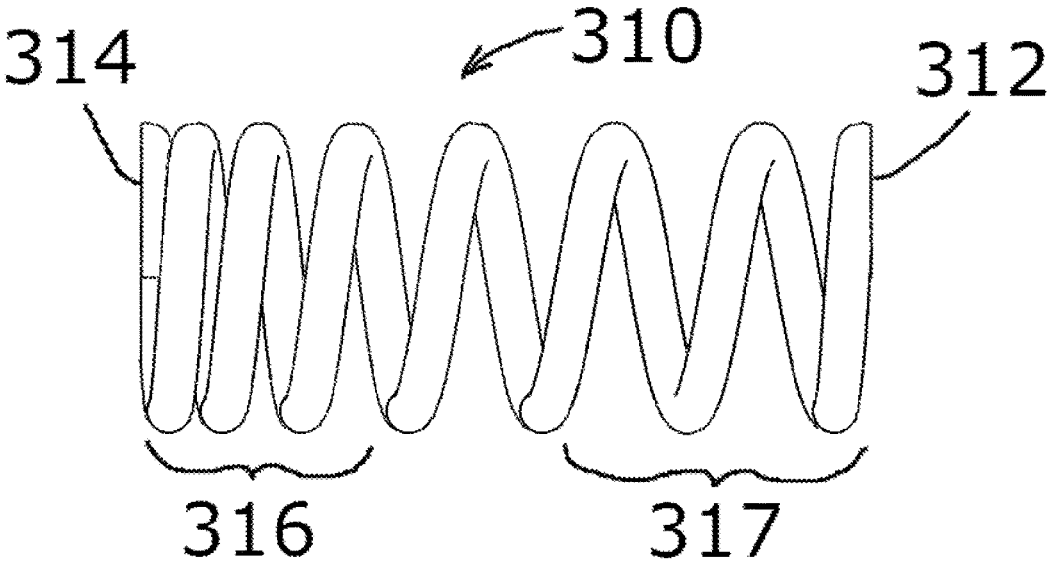
FIG. 29 is a side view of nonlinear variable pitch coil spring.

FIG. 29 shows spring 310 as a nonlinear, variable pitch, coil spring such that as spring 310 is compressed, the spring rate may increase in order to more evenly space apart indicator lines 324*a-e*. In the case of a variable pitch spring, movement of the adjuster, e.g., adjustment dial 320, may adjust both the preload and the spring rate. A linear coil spring may also work, although indicator lines 324*a-e* may be increasingly farther apart as the torque setting is increased and the overall length of spring 310 would need to be increased, which would increase the overall size of tool 300.

Figure 30:
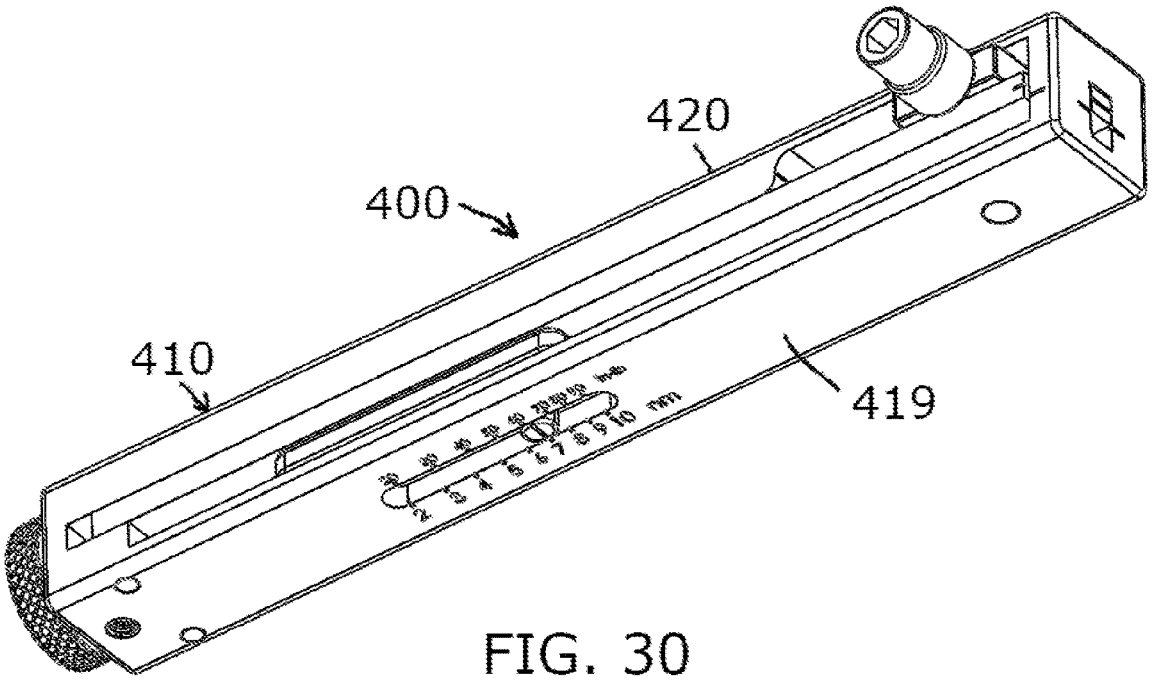
FIG. 30 is a 3D view of a third embodiment of torque indicating tool set to 7 Nm.
Figure 31:
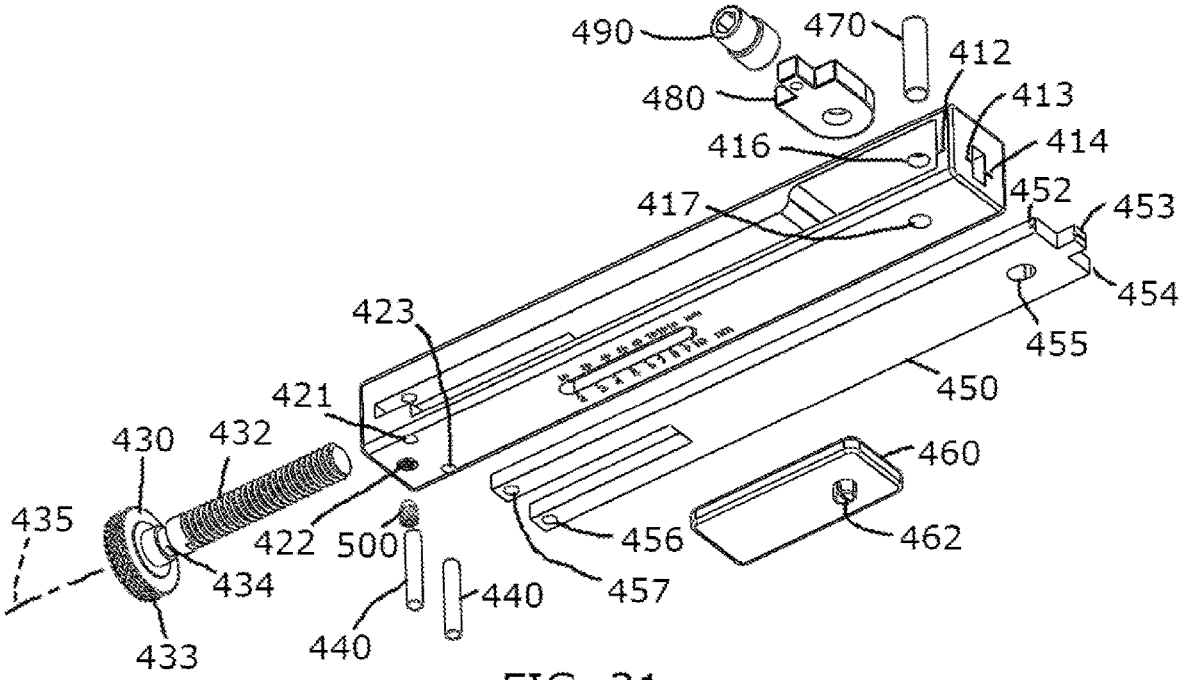
FIG. 31 is an exploded view of the third embodiment of torque indicating tool.
Figure 32:
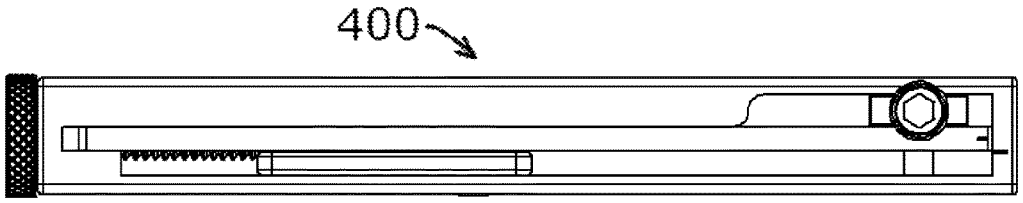
FIG. 32 is a side view of the third embodiment of torque indicating tool.
Figure 33:
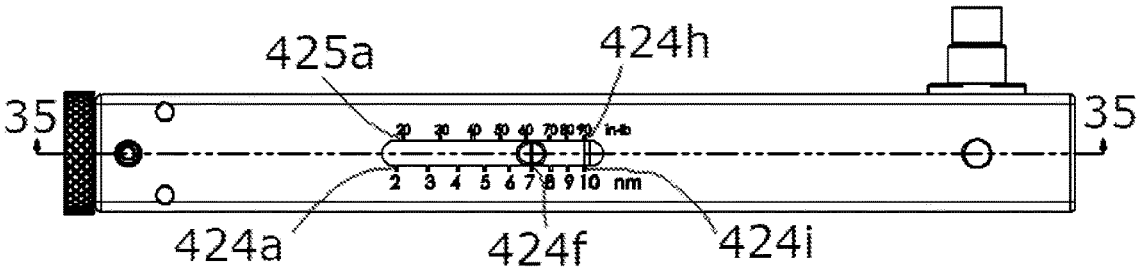
FIG. 33 is a top view of the third embodiment of torque indicating tool.
Figure 34:
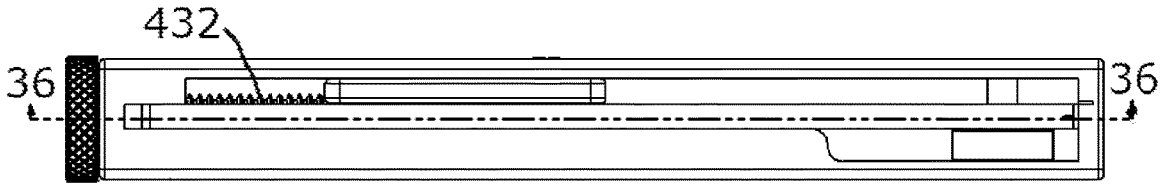
FIG. 34 is side view of the third embodiment of torque indicating tool.

FIGS. 30-31 show, yet another alternative embodiment of torque indicating tool 400, which may be generally comprised of support unit 410, a dial 430, pins 440, 470, a spring 450, a slider 460, a tool driver 480, a socket 490, and a set screw 500. Support unit 410 may be include two opposed walls/supports 419, 420. Socket 490 may be representative of a socket that fits tool driver 480, but a large variety of sockets are readily available in the marketplace for driving fasteners of all types such as with hex holes, torx holes, and hex heads of assorted sizes. The operating function of tool 400 may be similar to tool 10, but instead of multiple tool bits, there may be a single driver, and instead of the slider 60 in tool 10 being positioned by directly pushing on slider 60, tool 400 may include adjusting dial 430 that when turned about axis 435, causes slider 460 to move relative support unit 410 and spring 450 along spring axis 451 defined by the longitudinal dimension of spring 450. An advantage of tool 400 may be that the tool 400 may include extra overall length which produces more leverage to achieve higher torque values. Also, the adjustment dial 430 may provide more security against accidentally moving slider 460 out of position.

Figure 35:
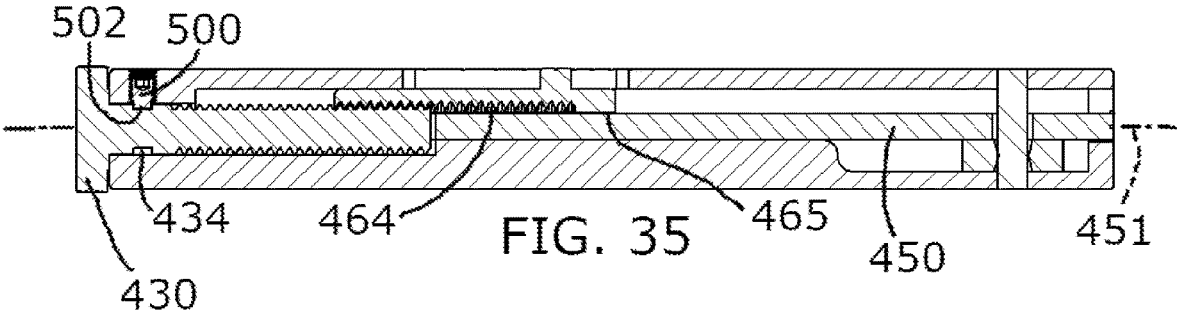
FIG. 35 is a section view of the third embodiment of torque indicating tool shown in FIG. 33.
Figure 36:
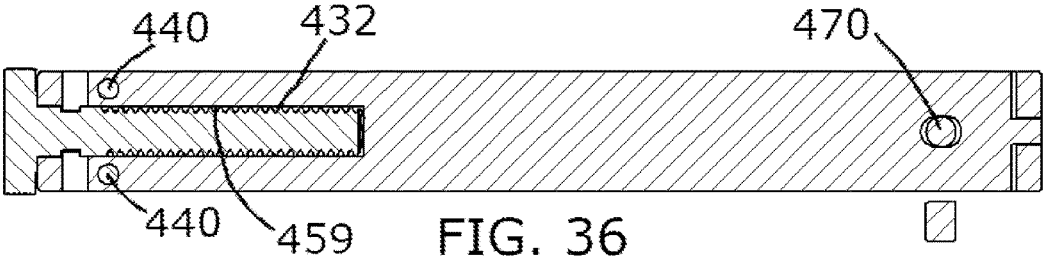
FIG. 36 is a section view of the third embodiment of torque indicating tool shown in FIG. 34.
Figure 37:
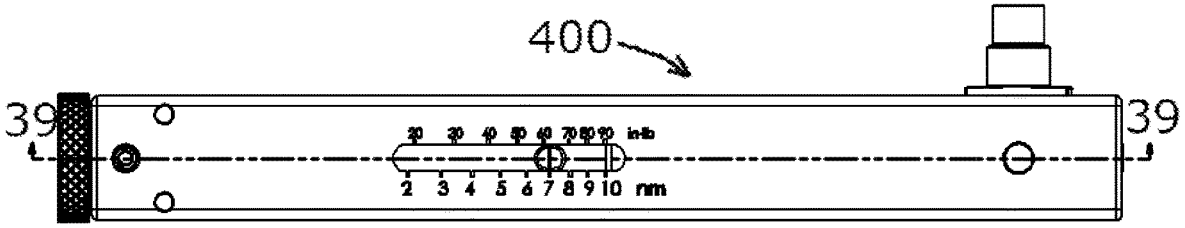
FIG. 37 is top view of the third embodiment of torque indicating tool tightening a fastener (not shown) to 7 Nm.
Figure 38:
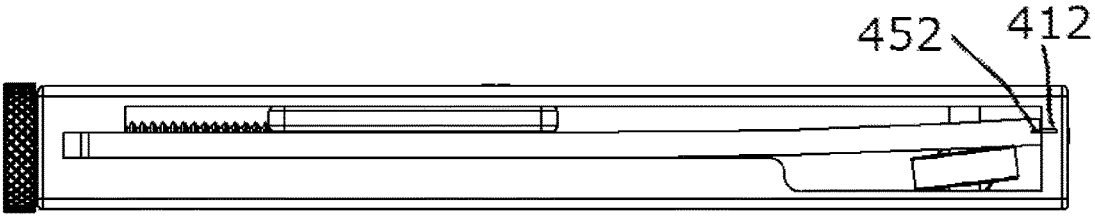
FIG. 38 is a side view of the third embodiment of torque indicating tool shown in FIG. 37.
Figure 39:
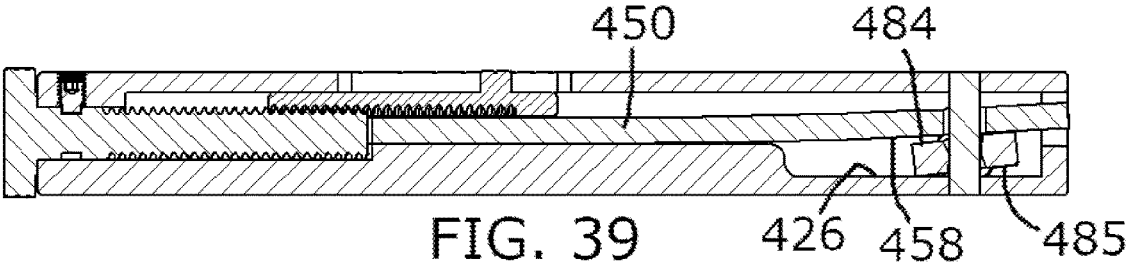
FIG. 39 is a section view of the third embodiment of torque indicating tool shown in FIG. 37.
Figure 40:
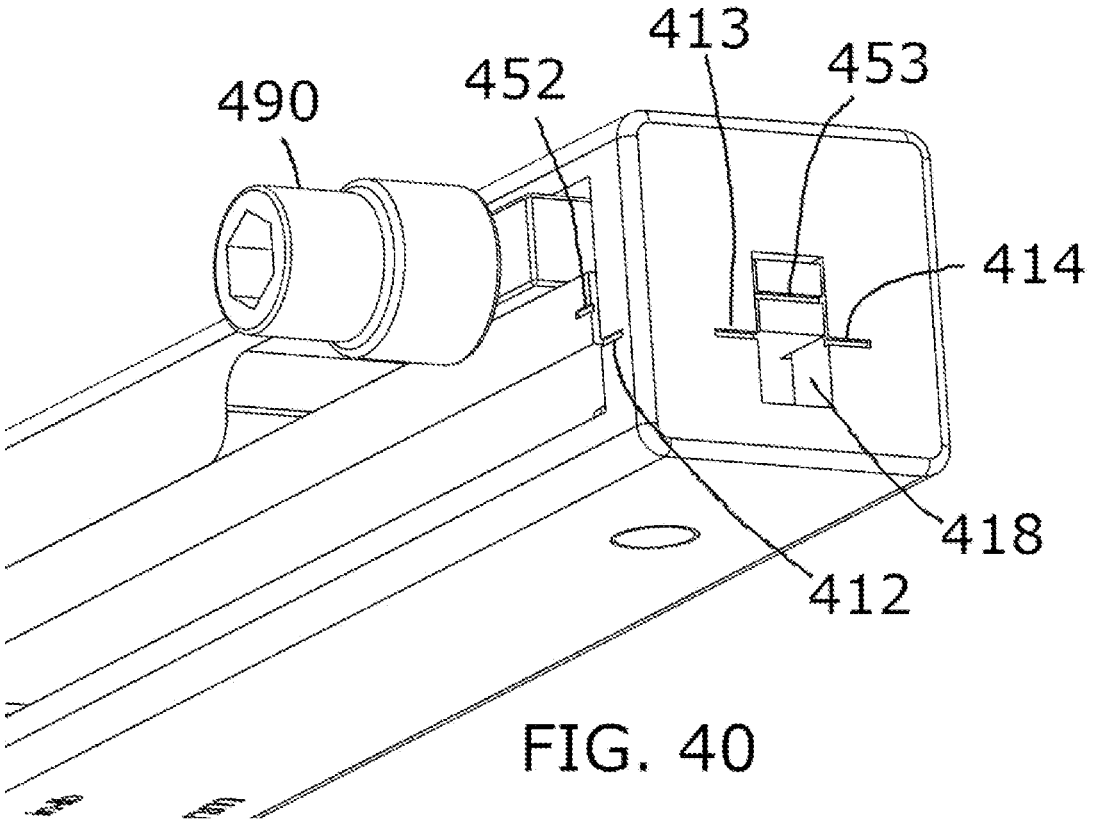
FIG. 40 is a close up 3D view of the third embodiment of torque indicating tool with no torque applied.

In the exemplary embodiment, torque values of 2-10 Nm may be achieved, but by using a stiffer spring 450 (or by allowing slider 460 to move farther), torque values that are higher may be achievable. Spring 450 may include indicator lines 452, 453, 454, and slider 460 may include indicator line 462. The tool 400 may include a set screw 500 (see FIG. 35) having a tip 502 that fits within groove 434 of adjustment dial 430 to secure adjustment dial 430 within support 410 while allowing turning. Adjustment dial 430 may include a thread 432 which engages with thread 464 of slider 460 (see FIGS. 35 and 39). For storage, with socket 490 removed, tool driver 480 can pivot inwards to be stored inside of support 410.

FIGS. 32-36 and 40 show tool 400 as having indicator lines 424*a-i* for Nm indications and indicator lines 425*a-h* for in-lb. indications. As shown, indicator line 462 on slider 460 is aligned with indicator line 424*f* for a torque value of 7 Nm. Thread 432 of adjustment dial 430 fits within slot 459 of spring 450. Spring 450 may be secured to support 410 by two pins 440 fitting holes 421, 423 of support unit 410 and holes 456, 457 of spring 450. Set screw 500 may threadingly engage into threaded hole 422 of support unit 410. No torque is being applied to tool 400 as depicted in FIGS. 32-36. Spring 450 includes indicator lines 452, 453, 454, while support unit 410 has indicator lines 413 and 414.

FIGS. 37-39 and 41 show tool 400 set for tightening a fastener (not shown) to 7 Nm of torque. Slider 460 has been set to 7 Nm and tool driver 480 may apply sufficient torque to a fastener to twist in order to bend spring 450 and cause indicator line 452 to align with indicator line 412.

Figure 41:
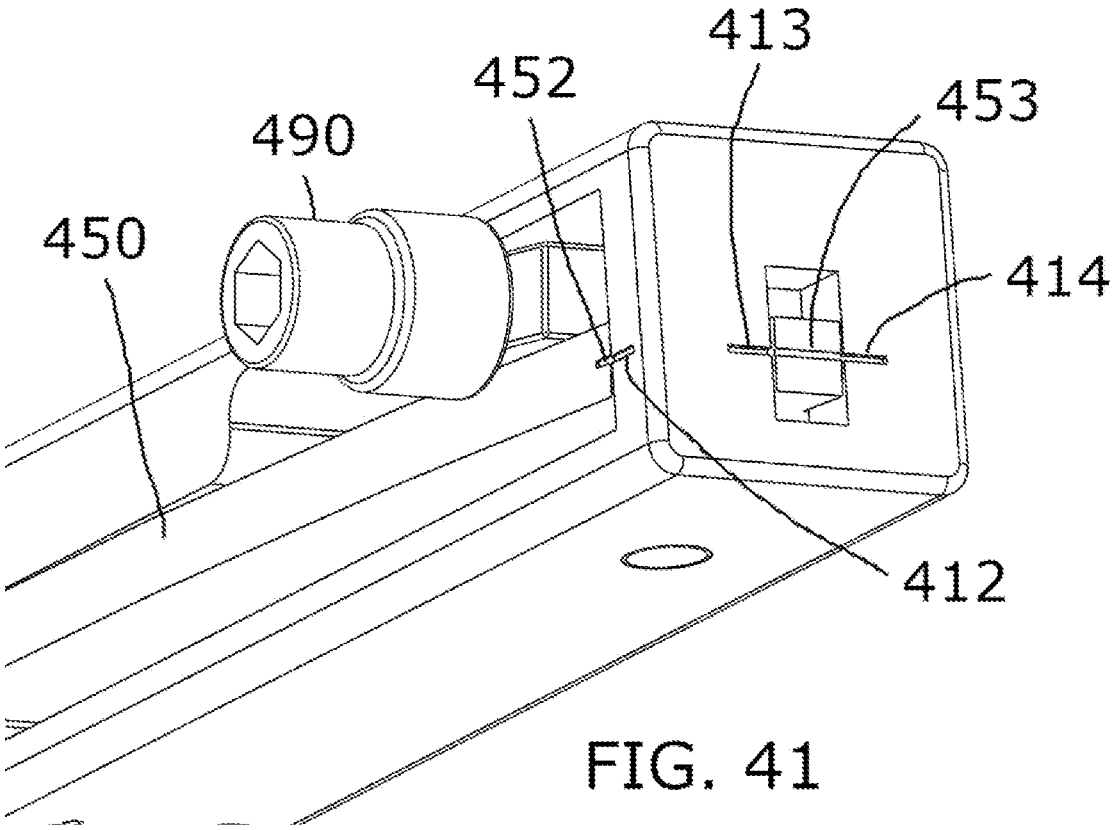
FIG. 41 is a close up 3D view of the third embodiment of torque indicating tool tightening a fastener to a preset torque.

Slot 455 may be minimally sized, but could be increased more similar to slot 57 of spring 50 in tool 10 in order to more evenly space indicator lines 424*a-i* and 425*a-h* apart. As torque may be applied, tool driver 480 surface 485 pushes against surface 426 of support 410 and tool driver surface 484 pushes directly against spring 450. FIG. 41 shows that indicator lines 452 become aligned with 412, while indicator lines 413, 414 become aligned with indicator line 453, which indicates that the set torque (7 Nm in this example) has been met.

In an alternative embodiment, tool 400 may employ a coil spring and adjustment dial similar to tool 300. Furthermore, tool 400 may use a slider like tool 10 instead of an adjustment dial 430. While tool 400 includes a single tool driver 480, it is contemplated that additional tool bits may be added.

While tools 10, 300, and 400 are all configured for visual alignment of indicator lines, alternative embodiments may be configured to generate an audible signal when the torque value is reached. For example, a "click" sound may be produced when alignment occurs by having a flexible finger flick past a ridge. Alternatively, an electrical contact could cause an electronic sound to occur and/or a light to illuminate when alignment occurs.

Another alternative modification may relate to the use of angled surfaces inside of tool bits 140-180. Along these lines, other ways for allowing twisting during torque while keeping the tool bits relatively concentric may be used, such as using a rubber component between tool bits 140-180 and shaft 80. For example, an o-ring between the internal diameter of the tool bit and the outer diameter of the shaft would allow twist and rotation while maintaining concentricity when not twisted.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A selectively adjustable torque indicating tool for rotating a mechanical fastener to a predetermined torque setting, the torque indicating tool comprising:

a pair of supports extending in opposed relation to each other;

a first tool bit positioned between the pair of supports and engageable with the mechanical fastener along an engagement axis such that when the first tool bit is rotated about the engagement axis, a rotational force is imparted on the mechanical fastener to urge the mechanical fastener to rotate about the engagement axis when the first tool bit is engaged with the mechanical fastener;

a leaf spring coupled to the pair of supports and having an opening formed therein, and operatively coupled to the first tool bit, the leaf spring having a first end portion that is movable relative to the pair of supports between a neutral position and a torqued position in response to the rotational force being imparted on the mechanical fastener by the first tool bit;

a shaft extending through the opening and between the pair of supports; and an adjuster coupled to the leaf spring to adjust a stiffness of the leaf spring such that movement of the first end portion of the spring from the neutral position to the torqued position corresponds to a predefined rotational force.

2. The torque indicating tool recited in claim 1, wherein the first tool bit is coupled to the pair of supports such that the first tool bit is rotatable relative to the pair of supports about a rotation axis.

3. The torque indicating tool recited in claim 2, wherein the first tool bit is moveable relative to the pair of supports in a manner separate from movement about the rotation axis.

4. The torque indicating tool recited in claim 1, the first tool bit being rotatable about the shaft.

5. The torque indicating tool recited in claim 4, wherein the first tool bit includes a first surface, an opposing second surface, and an opening extending between the first and second surfaces, the opening having a variable diameter that is of a minimum magnitude at an approximate midpoint between the first and second surfaces.

6. The torque indicating tool recited in claim 1, wherein the leaf spring defines a spring length corresponding at least in part to the position of the adjuster relative to the leaf spring, such that spring rate is adjustable via movement of the adjuster relative to the leaf spring.

7. The torque indicating tool recited in claim 6, wherein the adjuster is translatably coupled to one of the pair of supports.

8. The torque indicating tool recited in claim 1, wherein the opening in the leaf spring is a slot.

9. The torque indicating tool recited in claim 1, wherein the first tool bit includes a fastener engagement portion engageable with the mechanical fastener, the fastener engagement portion being engageable with an Allen screw.

10. The torque indicating tool recited in claim 1, further comprising a second tool bit separate from the first tool bit and positioned between the pair of supports.

11. The torque indicating tool recited in claim 10, wherein the first and second tool bits are independently moveable relative to the pair of supports.

12. The torque indicating tool recited in claim 10, wherein the first and second tool bits are each independently rotatable relative to the pair of supports between a respective stowed position and a respective use position.

13. The torque indicating tool recited in claim 12, wherein each of the first and second tool bits includes a shaft, the shaft extends generally parallel to the pair of supports when the corresponding one of the first and second tool bits is in its respective stowed position, and the shaft extends generally non-parallel to the pair of supports when the corresponding one of the first and second tool bits is in its respective use position.

14. A torque indicating tool comprising:

a pair of supports;

a first tool bit coupled to the pair of supports and rotatable relative to the pair of supports about a rotation axis and further moveable relative to the pair of supports about a first torque axis offset from the rotation axis;

a second tool bit coupled to the pair of supports, the second tool bit being rotatable relative to the support about the rotation axis, the second tool bit further being moveable about a second torque axis offset from the rotation axis;

a spring extending along a spring axis between a first end and a second end thereof; and an adjuster operatively coupled to the spring and moveable relative to the spring along the spring axis to define a bendable portion of the spring as that portion of the spring between the adjuster and the first end of the spring, the bendable portion of the spring defining a spring rate such that movement of the adjuster along the spring axis adjusts the spring rate;

the spring being operatively coupled to the first tool bit such that movement of the first tool bit about the first torque axis causes the bendable portion of the spring to move relative to the support.

15. The torque indicating tool of claim 14, wherein the spring is operatively coupled to the second tool bit such that movement of the second tool bit about the second torque axis causes the bendable portion of the spring to move relative to the support.

16. The torque indicating tool recited in claim 14, wherein the first tool bit includes a first surface, an opposing second surface, and an opening extending between the first and second surfaces, the opening having a variable diameter that is of a minimum magnitude at an approximate midpoint between the first and second surfaces.

17. The torque indicating tool recited in claim 14, wherein the spring includes a slot formed therein.

18. A selectively adjustable torque indicating tool for rotating a mechanical fastener to a predetermined torque setting, the torque indicating tool comprising:

a pair of supports extending in opposed relation to each other;

at least two tool bits positioned between the pair of supports, at least one of the at least two tool bits being engageable with the mechanical fastener along an engagement axis such that when the at least one of the at least two tool bits is rotated about the engagement axis, a rotational force is imparted on the mechanical fastener to urge the mechanical fastener to rotate about the engagement axis;

a spring coupled to the pair of supports, and operatively coupled to the at least two tool bits, the spring having a first end portion that is movable relative to the pair of supports between a neutral position and a torqued position in response to the rotational force being imparted on the mechanical fastener;

an adjuster coupled to the spring to adjust a stiffness of the spring such that movement of the first end portion of the spring from the neutral position to the torqued position corresponds to a predefined rotational force; and wherein the at least two tool bits are each independently rotatable relative to the pair of supports between a respective stowed position and a respective use position.

19. The torque indicating tool recited in claim 18, wherein the at least two tool bits are independently moveable relative to the pair of supports.

* * * * *